US006348646B1

(12) United States Patent
Parker et al.

(10) Patent No.: US 6,348,646 B1
(45) Date of Patent: Feb. 19, 2002

(54) MUSICAL INSTRUMENT STRINGS AND METHOD FOR MAKING THE SAME

(76) Inventors: Anthony Parker, 10 Columbine Cir., Newton, PA (US) 18940; Peter J. Rohrbacher, 10 Woodland Rd., Bordentown, NJ (US) 08505

( * ) Notice: Subject to any disclaimer, the term of this patent is extended or adjusted under 35 U.S.C. 154(b) by 0 days.

(21) Appl. No.: 09/649,483

(22) Filed: Aug. 28, 2000

(51) Int. Cl.[7] ..... G10D 3/00
(52) U.S. Cl. ..... 84/297 R; 84/297 S
(58) Field of Search ..... 84/290, 297 R, 84/297 S

(56) References Cited

U.S. PATENT DOCUMENTS

| | | | | | |
|---|---|---|---|---|---|
| 4,854,213 | A | * | 8/1989 | Infeld | 84/297 S |
| 5,693,899 | A | * | 12/1997 | Kalosdian | 84/297 S |
| 5,801,319 | A | * | 9/1998 | Hebestreit et al. | 84/297 S |
| 6,057,498 | A | * | 5/2000 | Barney | 84/297 S |

* cited by examiner

*Primary Examiner*—Marlon T. Fletcher
(74) *Attorney, Agent, or Firm*—Marshall &Melhorn, LLC.

(57) ABSTRACT

An improved musical instrument string combines the attributes of superior corrosion resistance, low stiffness, low tension at pitch, and long life during storage and end use. The potential for galvanic coupling between the winding and core of wound strings is minimized, or eliminated through the use of a cathodic core, which is preferably comprised of a titanium alloy; and metal windings of either titanium, nickel, a nickel alloy, or a surface modified copper alloy, where the preferred surface modifier is a compound from the azole family. The resultant strings are lower in stiffness, and impart a lower cumulative tension on stringed instruments when compared to conventional metallic strings. The ends of the strings, including both ends of the wound strings, as well as one end of the non-wound strings, are preferably encapsulated with polymeric sheathings to maintain winding tightness over time, to maintain tuning at pitch, to maintain sound quality over time, and to protect the instrument bridge from excessive wear during end use. Preferred polymeric sheathings, such as polyvinylidene chloride or nylon, are used outside the speaking length of the string, so as not to dampen or modulate the tonal characteristics of the string during its vibration.

22 Claims, 5 Drawing Sheets

MUSICAL INSTRUMENT STRINGS AND METHOD FOR MAKING THE SAME

BACKGROUND OF THE INVENTION

This invention relates to the construction and method for making musical instrument strings. More particularly, it relates to strings having superior corrosion resistance and longevity, low stiffness for improved playability and tonal quality, and low tension at pitch for reduced stress on musical instruments. The present invention is particularly adapted for use with bridged stringed instruments including classical guitar, steel string guitar, violin, cello, dulcimer, banjo, mandolin, bass, etc.

It is well known that strings under tension will vibrate when plucked, struck, or bowed at a characteristic fundamental frequency $f_1$, accompanied by a spectrum of n harmonic frequencies, all proportional to the tension and inversely proportional to the mass per unit length of the string (Jeans, Sir James, *Science And Music*, Dover Publications, Inc., New York, 1937, reprinted 1968). This relationship can be expressed for an ideal string of zero stiffness by equation 1:

$$f_n=(n/2L)(T/m)^{1/2} \quad [1]$$

where $f_n$ is the frequency of the nth harmonic, L is the speaking length of the string, T is the tension, and m is the mass per unit length.

In many cases, this ideal relationship can be used to adequately approximate the fundamental frequency as well as the first few harmonics for real strings under tension. However, since real materials have finite stiff-ness values, they do not completely obey the ideal relationship depicted above (Elmore, W. C. and Heald, M. A., *Physics of Waves*, Dover Publications, Inc., 1969). Instead, the stiffness of a real string will contribute to the elastic restoring force during string vibration, leading to inharmonicity, particularly with respect to the higher harmonics. Thus, when designing strings for musical instruments, these factors must be considered together with several other limiting factors of practical concern, including the "window of tension" for a particular instrument, the physical properties of both core and winding materials, and the suitability of materials for string fabrication.

For example, lower frequency musical instrument strings are often helically wound with mass loading materials such as alloys of copper, steel and nickel so that the unit mass can be controlled within some "window of tension" without having to increase the speaking length or the mass of the core string. Otherwise, the speaking lengths for bass strings would be unrealistically long, and/or the diameter and mass would be too high, leading to high stiff-ness, reduced tonal quality, and difficulty with fingering during instrument play.

The "window of tension" is determined in part by the construction and design of the instrument, and specifically by the cumulative tension that can be sustained when a plural set of strings is tuned to pitch. Thus, if the tension is maintained at too high of a value, the instrument can be permanently damaged. If the tension is too low, then unwanted resonances and buzzing noises may occur. For example, the cumulative tension for strings on a "classical guitar" is typically between 75 and 100 pounds, whereas the cumulative tension on a steel-stringed acoustic guitar can be as high as 190 pounds.

Like string stiffness, tension can also affect "playing action", or the pressure required for fretting during play. There is some latitude for tension adjustment with conventional string materials, as long as the cumulative tension falls within the "window of tension" that provides the best overall response from the instrument. For example, it is possible to reduce the diameter and hence stiffness and tension of steel core strings, but only to the point where the strength, loudness, and sound quality are not seriously compromised.

In addition to the "window of tension", musical instrument string designers are constrained by the physical properties of conventional materials. Although some material improvements have been made, the most commonly used materials for the cores of wound musical instrument strings still include polymers such as synthetic nylon or natural "gut", and steel (for example, music spring wire that is currently manufactured according to ASTM A228 specifications).

A core material must have the ability to maintain dimensional stability without breaking under tension. Hence it must possess the combined characteristics of high tensile strength, low creep, high yield strength, and low ductility. On the other hand, windings, such as those used with conventionally wound steel core strings, are typically made of softer, more ductile metals such as alloys of copper, steel, or nickel. These alloys can possess various degrees of hardness or temper, and are typically chosen for their ability to control the mass per unit length, and for their ductility or yield characteristics for ease of manufacturing.

Although the use of metal windings has historically enabled designers to control mass per unit length and hence pitch, one inherent problem with wound strings is that the windings tend to move, slip, and re-position themselves with respect to the core during end use. This leads to increasingly higher frictional losses and vibrational damping, with the upper harmonic frequencies being particularly affected. Gradually, the tonal quality deteriorates and the string loses its "liveliness" and "brilliance". The problem may be partly related to stress relaxation from winding recoil, but it is also compounded by interfacial deterioration from corrosion at the core/winding interfaces, and from yielding of ductile interfacial materials such as tin or tin alloys. Steel core corrosion byproducts such as $Fe_2O_3$ are also weak oxides, and can easily spall, leading to mechanical losses and oxide particle contamination which can further dampen vibrations and negatively impact tonal quality. Together, these problems ultimately lead to what many musicians recognize as a "dead" string.

Furthermore, conventional strings have a limited shelf-life, and often require special packaging considerations and/or storage conditions to prevent corrosion, and to preserve their tonal characteristics prior to use. In some cases, strings which have been stored for long periods can become weakened from corrosion, and can break when attempts are made to tune the strings to pitch. In other cases, the otherwise "new" strings can exhibit the tonal characteristics of "dead" strings simply because they were stored too long before use.

Several prior art examples have addressed one or more of these issues through methods and constructions aimed at improving the longevity of wound strings. U.S. Pat. No. 210,172 to Watson and Bauer (1878) disclosed the first use of polygonal shaped core wires that unlike round cores, help to prevent winding recoil both during manufacture and in end use. This technology is still commonly used today for steel core wires of wound guitar strings such as the hexagonal steel cores used by J. D'Addario & Company, Inc. in their Phosphor Bronze wound acoustic guitar strings.

U.S. Pat. No. 2,746,335 to Johnson (1956) discloses a concentrically wound core wire where the inner wire is terminated in a tapered gripping fashion over a flattened section near the core end. The purpose is to maintain winding tightness and to prevent buzzing. U.S. Pat. No. 5,535,658 to Kalosdian (1996) discloses a plurality of metallic inner wrap wires wound about a central metallic core, and concentrically wound with an outer wrap of metallic wire over the speaking length of the string to maintain tightness of the inner windings over time. The outer wrap traverses the speaking length of the string and thus it contributes to the mass per unit length, the tonal quality, the diameter, and the string stiffness accordingly. U.S. Pat. No. 3,605,544 to Kondo (1971) discloses a musical instrument string with a core wire and a helically wound covering wire where the winding pitch is greater than the diameter of the covering wire. The purpose is to eliminate contact between adjacent turns so that frictional losses at winding interfaces can be eliminated.

Several other prior art examples teach of constructions and methods aimed at improving the properties of musical instrument strings. U.S. Pat. No. 4,539,228 to Lazarus (1985) discloses a method for treating wound musical instrument strings to reduce the "break-in period" and to extend useful life by filling microscopic pores, cavities, and interstitial spaces of wound strings with dry lubricant particles, moisture displacement agents, and corrosion inhibitor.

U.S. Pat. Nos. 5,883,319 and 5,907,113 to Hebestreit, et al. (1999) disclose wound and non-wound musical instrument strings that are covered with a porous polytetrafluoroethylene polymer over a portion of the speaking length, or over the entire speaking length of the string for the purpose of providing corrosion resistance, comfortable play, less finger noise, and longer life (these strings are commercially available from W. L. Gore & Associates, Inc.). The coating traverses the speaking length of the string and therefore modulates the tonal and dampening characteristics accordingly.

U.S. Pat. No. 2,892,374 to Ralls (1959) discloses a conditioning process where a musical instrument string with a metallic winding wrapped about a gut core is treated by soaking the strings in a polymer lacquer solution to coat the core and to fill the interstitial spaces between core and windings along the entire speaking length of the string. The purpose is to prevent shrinkage of the gut core and to prevent loosening of windings during end use, both of which lengthen string life. Similarly, since the polymer traverses the entire speaking length, tonal quality, stiffness, and playability are affected accordingly.

U.S. Pat. No. 2,049,769 to Gray (1936) discloses a string constructed with a varnish reinforced fabric that encircles a straight or kinked metal core along its entire length to form a unitary string body. Metal windings can be incorporated either between the fabric and core, or they can be wrapped around the unitary composite core. This string owes its properties to its composite nature, where the fabric is incorporated to carry a portion of the tensile load in concert with a steel core wire. The polymer and fabric traverse the entire speaking length, so tonal qualities, dampening, stiffness, and playability are all affected.

U.S. Pat. No. 5,578,775 to Ito (1996) discloses an instrument string made with a composite core of fibrous materials such as carbon, ceramic, or metal; and sheathed with ductile precious metals such as gold, platinum or silver for modulation of mass per unit length, and for aesthetic value. The fibers provide the reinforcement required for a high strength core, and the metal sheathing provides the ability to modulate mass per unit length as well as to provide a surface with high ductility. This highly ductile surface also becomes the area of contact between the winding and the core. The same precious metal composite is disclosed for use as a winding either on a steel core, on an organic core, or on a similar composite core.

U.S. Pat. No. 5,817,960 to Sanderson (1998) discloses concentrically wrapped wires about a central core, where the first is wrapped along the entire core length, and the second is wrapped over or under the first near the core end. The second wrap wire only serves to compensate for inharmonicity introduced by a bare end wire.

U.S. Pat. No. 2,710,557 to Sundt (1955) discloses a set of musical instrument strings where the wound strings are composed of a plurality of small diameter wires bound in composite form by an elastomeric polymer over the entire speaking length of the string. The elastomer provides a base over which windings can be tightly wound. The elastomer also contributes to the tonal and damping characteristics of the string since it traverses the entire speaking length.

U.S. Pat. No. 5,704,473 to Oster (1998) discloses musical instrument strings and controlled atmosphere packaging with a flexible polymer material covering the end opposite the ball end of the string for the purpose of color identifying strings that are packaged together in a single pouch, where the pouch is designed to hold a non corrosive gas to reduce string corrosion. The coating is formed through a liquid dip/cure process and is also designed to be either permanent or removable after the string end is inserted through the tuning post of the musical instrument. The coating reduces the hazard of injury when uncoiling the string.

Although several of these references disclose string constructions and methods for enhancing string life by some combination of either slowing corrosion, or by adhesively/mechanically maintaining tight windings over time, none of these teachings address the fundamental problem of preventing corrosion. Many traditional metal wound steel core strings are inherently flawed from the standpoint that the junction points between windings and the steel core provide the potential for galvanic coupling and corrosion. The corrosion process can be readily accelerated by moisture and ions from dissociated salts, organic acids, or other contaminates that originate from human hands during instrument use. These conventional constructions are also known to oxidize and corrode from simple atmospheric exposure, which greatly limits shelf life, and causes string deterioration even before end-use.

It is generally known that corrosion of the anodic component in a galvanic couple is accelerated as the ratio of the surface area of the cathodic metal to the anodic metal increases (*Metals Handbook Desk Edition*, second edition, J. R. Davis-Editor, ASM International, Materials Park, Ohio, 1998). In the case of conventionally wound steel core strings, the steel core is typically the more anodic of the coupled pair, and it also has the least amount of exposed surface area. Even worse, the iron oxides that form at the anode are mechanically weak oxides, which easily spall, leading ultimately to shearing motions and contamination at multiple interfaces, and vibrational dampening in the form of frictional heat dissipation. In order to minimize corrosion, it would be desirable to either construct the string with electrochemically equivalent materials, or if some degree of galvanic coupling is inevitable, to design by minimizing the surface area of the cathodic member. However, no such design has been implemented to date with steel core musical instrument strings.

Instead, many steel cores for wound guitar strings are typically surface treated with malleable metals such as tin, tin alloys, gold, or silver for the purpose of decreasing the rate of corrosion, and for helping to maintain initial winding tightness. U.S. Pat. No. 4,063,674 to Stone and Falcone (1977) discloses a method of manufacture whereby a wound string assembly is heated at an elevated temperature for various amounts of time to produce a string where windings are more evenly spaced. The coefficient of thermal expansion of the core is less than that of the winding, and the core is coated with a material having a melting point lower than the heat treatment temperature. The invention discloses a tin coating that upon heating, can be used to form a metallurgical bond between winding and core.

It is generally known that surface coatings such as tin can reduce the galvanic couple between steel and other metallic materials, but corrosion is not entirely prevented (see for example McKay, R. J. and Worthington, R., *Corrosion Resistance of Metals and Alloys*, American Chemical Society Monograph Series, Reinhold Publishing Corporation, New York, 1936). The malleability of Sn can enable it to yield and partially encase the winding during processing to help maintain initial tightness. However, this same attribute can also be a long term detriment since the ductility of tin renders it susceptible to yielding under the recoil stress of the windings, a problem which is further aggravated by corrosion since bi-products may further weaken the material near the chemically dissimilar interfaces. Thus, short term durability and ultimate interfacial failure are simultaneously and paradoxically inherent to the structural design of many conventional metal wound steel core strings.

In cases where polymers or lacquers have been used to either slow corrosion or to maintain winding tightness, they traverse either a portion of, or the entire speaking length of the string, and thus they influence the tonal and dampening characteristics of the string.

Alternatively, lower density polymeric strings such as gut and nylon are not susceptible to corrosion, and are used either alone or as the cores for metallic or polymeric wound strings. However, due to their organic nature, these types of strings are characterized by different dampening and tonal characteristics, and are used in cases where either different tonal characteristics are desired, or where lower tensions are mandated by virtue of instrument design.

When metal strings are desired for their tonal qualities, or for their magnetic properties as in the case of electric guitars with magnetic pickups, it becomes necessary to reinforce the construction of the musical instrument so that it can support and sustain the higher stress loadings. In the case of acoustic guitar bodies, this is accomplished through the incorporation of metal neck reinforcement bars, bridgeplate reinforcements, and other sound board reinforcements that help to prevent warpage and failure of instrument body components. Consequently, the need for a higher strength instrument body for use with steel core strings has necessarily limited the design and material possibilities for the construction of such instruments.

For example, when compared to a steel string guitar, a classical guitar is designed with less reinforcement under the sound board and near the bridgeplate. Thus, the resonating members of a classical guitar are lower in stiffness, which reduces the dampening contribution that is otherwise present with additional reinforcement materials. The tonal qualities of metallic core strings on such an instrument might in theory be aesthetically pleasing, but the possibility cannot be tested with current metal wound acoustic strings at conventional diameters, since their high cumulative tensions would damage or even destroy the instrument. Thus, there exists a need for low tension metallic strings that could be used on existing classical instruments. Such strings would also expand the material and design possibilities for instrument designers and manufacturers.

Another shortcoming of conventional wound strings results from the use of ball ends, which serve to fasten the string to the bridge of a stringed instrument. For example, the core of a guitar string is typically looped around an annular, spool shaped "ball end", and is then wound around itself to hold the end in place. This results in a transition step where subsequent slippage of windings can occur when the wound string is placed under tension. Winding slippage can often be heard as audible "bridge noises" during the first tuning of a new string, and can also continue during end use. As with any process which leads to winding slippage, this phenomenon can lead to changes in tuning, changes in intonation, or string deadening if the effect is longitudinally propagated over the speaking length of the string. This area of the string is also stiffer and higher in diameter than the remainder of the string. Thus, when the string is placed under tension, it can place additional stress on the instrument bridge, which is typically made of softer wood on acoustic instruments. This bridge stress is compounded by the use of conventional steel core wound strings, since high tensions are required to tune these strings to pitch on stringed instruments. Over time, this localized bridge stress results in "grooving" and deterioration of the softer wood. Hence, a need exists for a string with a modified end which reduces the stress on the bridge, and which also prevents windings from slipping during use.

Accordingly, it would be desirable and advantageous to develop a string construction where the galvanic couple between the contact metal surfaces is either eliminated, or where the lowest surface area member is the more cathodic member of the galvanic couple. It would also be desirable and advantageous to eliminate the use of malleable and ductile materials at the interface between the windings and core over the speaking length of the string so that the potential for long term yielding can be minimized during end-use. It would also be desirable to minimize or eliminate the use of any material within the speaking length of the string (other than core and winding) that can adversely influence the damping characteristics and hence affect tonal quality. It would also be advantageous to develop a metallic core string with the aforementioned characteristics that can be tuned to pitch at reduced tension so that when used in plurality on a stringed instrument, reduced cumulative tension is delivered to the instrument bridge, hence reducing instrument wear and prolonging instrument life. Still further, it would be advantageous to have a metallic instrument string that can be tuned to pitch at a sufficiently reduced tension so that when used in plurality as a set, the cumulative tension is low enough to render it useful for classical body constructions that are characterized by less structural reinforcement than their steel-stringed guitar counterparts. Finally, it would be advantageous for the instrument string to have reduced stiffness for better tonal characteristics (less inharmonicity), and for easier playability.

Accordingly, it is a primary object of the present invention is to provide a wound metallic musical instrument string with combined attributes of high corrosion resistance, low tension at pitch, and low stiffness.

Another object is to provide a musical instrument string with the benefits of lower stiffness including ease of play, and better tonal qualities.

Another object is to provide a musical instrument string with the benefits of improved corrosion resistance including longer shelf life before use, and longer life during end use.

Still another object of the present invention is to provide a plurality of metallic musical instrument strings that can be tuned to pitch at a sufficiently reduced tension, so that the cumulative tension is low enough to render the set useful for instrument body constructions that are characterized by less structural reinforcement than their steel string counterparts.

Yet another object of the present invention is to provide a method for manufacturing the strings of this invention whereby the tightness of windings is maintained both during manufacture and in end use.

Still another object is to provide a method for maintaining tight windings without ductile metals between the winding and core interfaces over the speaking length of the string.

Still another object is to provide a method for maintaining tight windings without the use of dampening polymeric materials within the speaking length of the string.

Another object of this invention is to provide a musical instrument string that protects the wood on the bridge of a musical instrument from wear which otherwise occurs from the continued use of unprotected metal strings.

These and other objects and advantages of the present invention will be more fully understood and appreciated with reference to the following description.

SUMMARY OF THE INVENTION

The present invention relates to an improved musical instrument string for use on instruments including but not limited to guitars, violins, mandolins, cellos, pianos, basses, etc. This invention is particularly suitable for use on instruments where the strings are handled during play such as guitars, basses and other hand held stringed instruments.

The string of the present invention employs a metallic core which can be spirally wound to produce lower pitched notes, where the core is either electrochemically equivalent to the winding, or is the more cathodic member of the coupled pair. The preferred string comprises a metal core of a titanium alloy wire, and a winding of either titanium, or a galvanically similar material such as nickel, a nickel alloy, or bronze. The string of the present invention is unique over all previous attempts to construct metallic strings in that the titanium alloy core is more cathodic, less dense, lower in modulus, and sufficiently strengthened so as to achieve the necessary tensile and yield characteristics to maintain pitch under tension without breaking. Unlike steel core strings, this string will resist corrosion for much longer durations of time. Also, the lower density translates to reduced tension at pitch, and hence longer instrument life, and easier playability. The lower modulus also equates to lower stiffness at an equivalent diameter core, which translates to improved tonal quality, and easier fretting during instrument use.

It has been determined that as the winding wire in the present invention becomes more anodic, corrosion of the winding can occur, but not corrosion of the core. Thus, the most preferred winding wire is one that is electrochemically matched to titanium. Nickel and titanium have been found to be exceptionally good materials for this purpose, although other alloys of nickel and stainless steel can be used as well. Unlike conventional steel core strings, the cathodic member of the string of the invention is the core itself. Thus, when compared to conventional steel core strings, the surface area ratio of anode to cathode is higher in this invention, which results in a slower rate of corrosion with otherwise the same difference in galvanic potentials. Furthermore, conventional windings for steel cores are more cathodic than the steel core, which further accelerates the corrosion rate in conventional strings. In this invention, the use of a more cathodic titanium core widens the number of alloy possibilities that can be used without adversely affecting the corrosion rate of the resultant string. Hence this invention makes it possible to produce the first completely corrosion resistant, all-metallic wound, musical instrument string, which has all of the positive tonal attributes of conventional steel-core metallic strings. The enhanced corrosion resistance made possible by this invention greatly increases string shelf-life, which is a positive benefit for manufacturers, and distributors, who otherwise have gone to great extremes to develop special and costly packaging and coatings to protect conventional strings from the elements that cause corrosion. Equally important, the corrosion resistance afforded by this invention makes it possible for strings to have longer life during use, since the strings of this invention will resist the otherwise detrimental effects of moisture and ions from dissociated salts, organic acids, and other contaminates that originate from human hands during instrument use.

If the strings of this invention are intended to be used on instruments with magnetic pickups, it is preferable for the winding to be ferromagnetic since the titanium core is non-ferromagnetic. The most preferred winding for this purpose is nickel, or a ferromagnetic nickel containing alloy, since the resultant string will also exhibit the benefits of excellent corrosion resistance. If ferromagnetic characteristics are not required for end use, nickel or nickel alloys can still be used as windings, but titanium or slightly more anodic alloys such as phosphor bronze can also be used. If a slightly more anodic metal such as a phosphor bronze alloy is used, enhanced performance can be achieved by treating either the wound string or the winding wire with a chemical compound from the azole family, including triazole compounds such as benzotriazole and 5-methylbenzotriazole. It has been found that these surface treatments significantly reduce the corrosion rate of strings made with phosphor bronze wound on titanium, whereas they have little to no effect on strings made with phosphor bronze wound around a conventional steel core.

It has also been determined that the strings of the present invention exhibit reduced tension at pitch when compared to equivalent diameter steel core strings that have been made with similar winding alloys. Thus, the present invention makes it possible to produce a plural set of metallic strings for use on instruments that otherwise must employ nylon strings, such as classical guitars. The preferred winding for the bass strings in such a set is titanium, while the preferred core is titanium for both the wound and non-wound strings.

The strings of the present invention are unique compared to conventional metallic steel core strings in that the stiffness is significantly lower at equivalent core and winding diameters, as well as at equivalent tensions. This is a significant attribute which translates to faster and easier "fingering" and "chording", both of which are huge advantages for the practicing musician. In addition, the lower pressure required for fretting should also translate to longer fret life, and a lower frequency of maintenance and fret re-surfacing.

By the very nature of this invention, ductile metal or polymeric surface coatings are not required for protecting the speaking length of the string from corrosion; although it is not the intent here to limit the use of such coatings if so desired for other attributes. Given that the core of the string of this invention is the more cathodic member of the galvanic couple, surface passivation with ductile coatings such as tin is not necessary. On the other hand, the absence of a ductile surface coating can make it more difficult to sustain a tightly wound structure during manufacturing, particularly if the chosen windings are high spring tempered alloys with low ductility.

In such cases, the performance of the present invention can be further enhanced by applying a sheathing material, such as a metallic sleeve or crimpable swage, a metallic brazing or coating, or a polymeric sleeve or coating, to a region outside the speaking length of the string for the purpose of maintaining winding tightness both during the manufacture step and during end use. Although the sheathing as described here could be used within the speaking length, it is most preferable to use these materials outside the speaking length so as to minimize effects on dampening and vibration attenuation. In a preferred method, the core of the string is looped around a conventional ball end which serves as the initial fastening point for the winding during a traditional spiral winding process. Either one or both ends, but preferably both, is sheathed with a polymer either before winding (over the core), after winding (over the wound core), or before and after winding. The polymer can be in the form of a heat shrinkable tube comprised of materials such as Teflon™ or other tetrafluoroethylene fluorocarbon polymers, PVC, and Kyna™ or other polyvinylidene fluorides; a heat shrinkable wound filament such as nylon; or a liquid based coating. The coating can be either water borne, solvent borne, neat, thermosetting or thermoplastic; and can be cured via photochemical or thermal initiation means.

Any one of these polymers could be employed for purposes of the present invention; either separately or in combination. However, the most preferred method employs a heat shrinkable, semi-rigid, high tensile strength, polymer tube such as Kynar, which is placed over both ends of the wound string outside of the speaking length, and is heat shrunk over the windings to tightly encapsulate the windings around the core, thus eliminating the potential for stress relaxation and winding recoil. It is important that the sheathing be used outside the speaking length of the string, so as to avoid affecting the tonal qualities during string vibration. It is also important that the sheathing exhibit high tensile strength and low elongation under load, so that it can sustain the torsional recoil stress of the windings, and can also sustain the tensile stress imparted by the tuning tension, particularly at the ball end where the potential exists for lateral winding slippage. The sheathing near the ball end can also serve to protect the wood on the bridge from wear, which otherwise occurs from the continued use of unprotected metal strings. The heat shrinking step can be accomplished in this process by either applying heat locally to the sheathed end(s), or by heating the entire string during or after winding, via any means including resistance or convection heating.

The preferred heat shrinkable tube has an inside diameter that is initially greater than the diameter of the wound string, and has a final outside diameter after heat shrinking which is small enough to enable the string to be strung through the holes of tuning posts on conventional instruments. The performance of this string can be further enhanced if before the heat shrinking and winding steps, an optional coating base is applied to the core opposite the ball end, or a nylon filament is wound around the same end. Such a base can provide either enhanced friction or bonding between the core and winding during the winding step, and thus can either serve to maintain winding tightness by itself, or can be used together with the preferred heat shrinkable polymer sheathing, which otherwise encases the entire wound structure, but outside the speaking length of the string.

Regardless of the choice of materials for the sheathing (i.e., metallic or polymeric), it is preferred that the sheathing be employed outside the speaking length of the string so as to not affect tonal characteristics during string vibration.

BRIEF DESCRIPTION OF THE DRAWINGS

The present invention should become apparent from the following descriptions in conjunction with the attached drawings, summarized as follows.

DETAILED DESCRIPTION OF PREFERRED EMBODIMENTS

The present invention is an improved string for use on a variety of musical instruments including but not limited to guitar, bass, violin, cello, mandolin, banjo, piano, etc.

Figure 1:
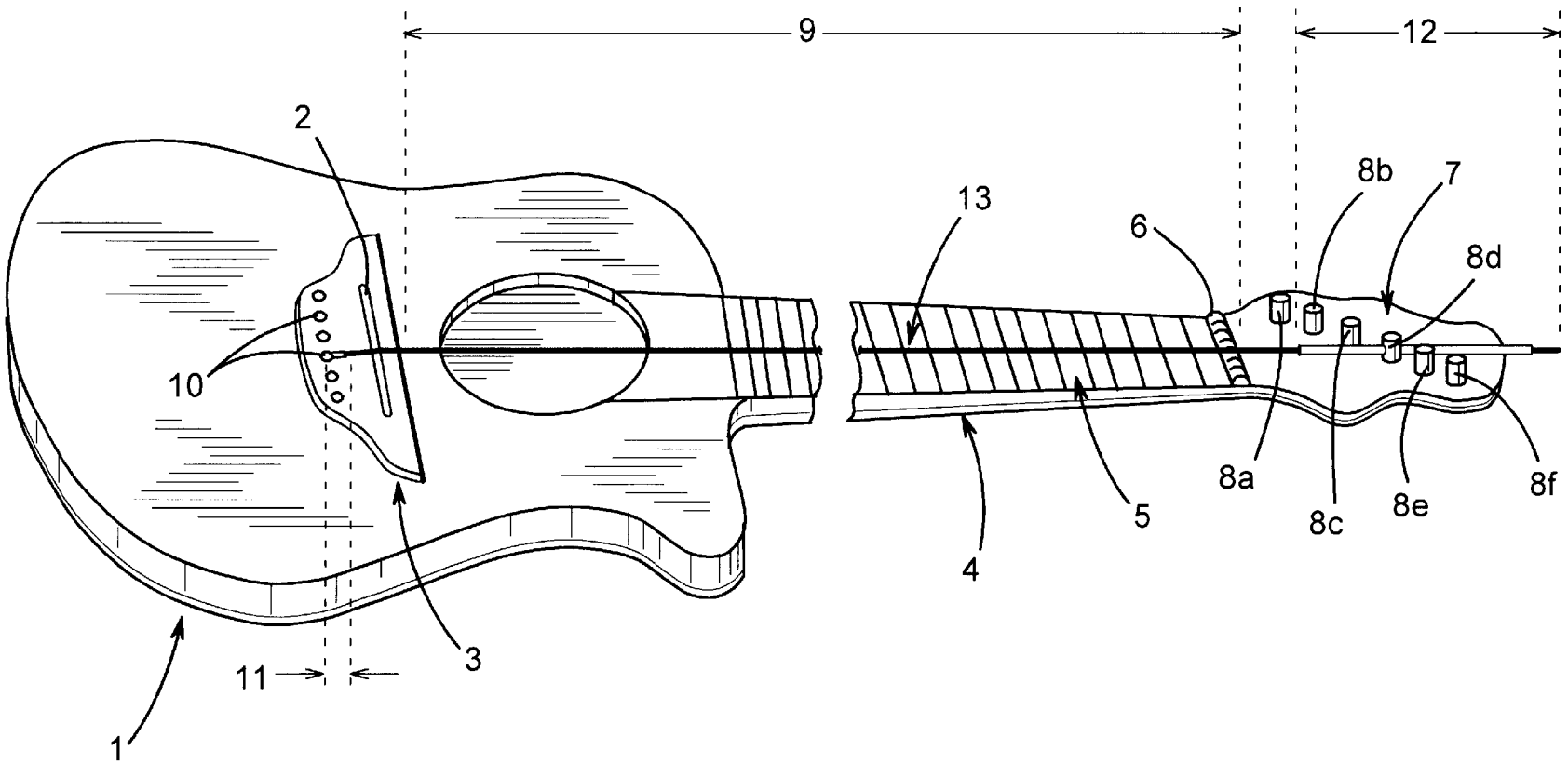
FIG. 1 shows a perspective view of a guitar body together with all of its pertinent components, as well as a somewhat schematic perspective view of the wound string of this invention.

FIG. 1 illustrates a conventional six string guitar composed of a "body" 1, a "bridge saddle" 2, a "bridge support structure" 3, a "neck" 4, a "fretted fingerboard" 5, a "nut" 6, six tuning posts 7 around which the six strings can be wound and tightened until the desired pitch values are achieved. A typical six string guitar is strung in all six positions, 8*a*, 8*b*, 8*c*, 8*d*, 8*e*, 8*f*; with wound strings typically in the 8*a*, 8*b*, and 8*c* positions; with non-wound higher note strings typically in the 8*e* and 8*f* positions; and with either a wound or non-wound string in the 8*d* position. The strings in these positions are conventionally tuned to "E" at 82 Hz (8*a*), "A" at 110 Hz (8*b*), "D" at 147 Hz (8*c*), "G" at 196 Hz (8*d*), "B" at 247 Hz (8*e*), and "high E" at 330 Hz (8*f*). The lower note strings are generally wound with metals of sufficient density to achieve the desired mass per unit length over the "speaking length" 9 of the string, which is depicted in FIG. 1 as the distance between the bridge saddle 2 and nut 6. The "speaking length" as used herein is typically taken as 25.5" for the conventional guitar, and can be greater or less than this value for other types of musical instruments.

Figure 2:
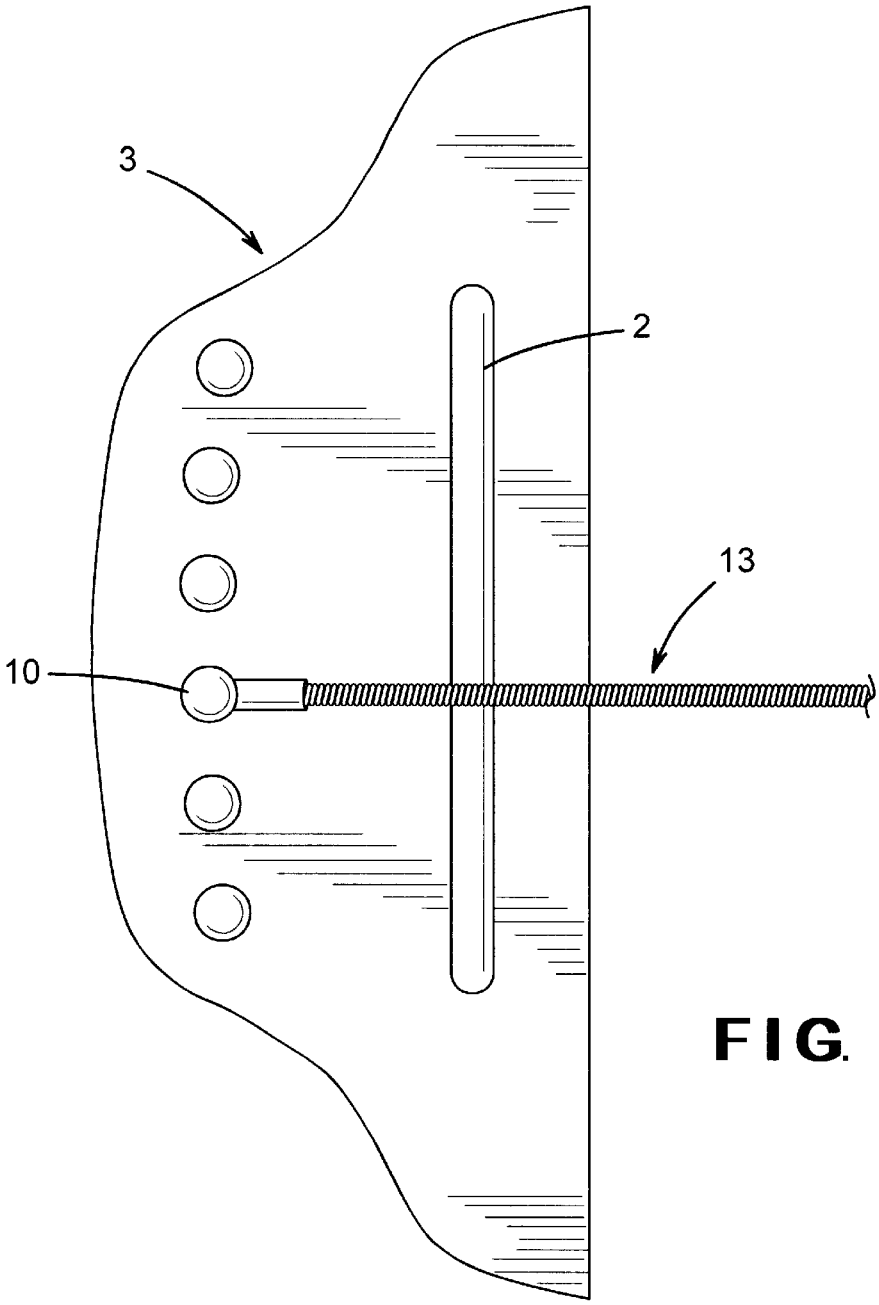
FIG. 2 shows a magnified view of the bridge section of the instrument body shown in FIG. 1.
Figure 3:
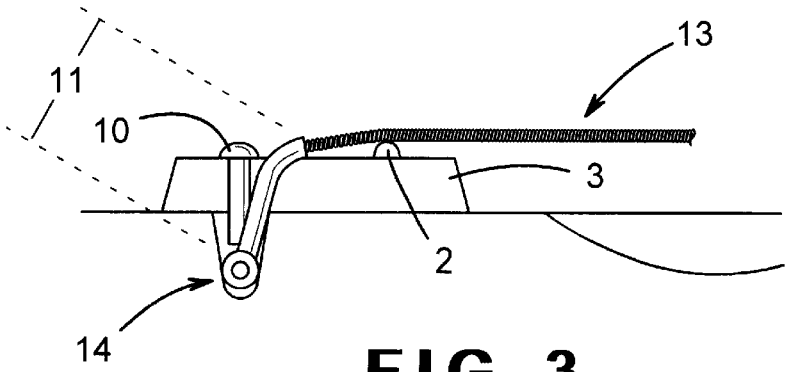
FIG. 3 shows a cross sectional view of the bridge section shown in FIG. 2.

The cores of the wound strings as well as the non-wound strings are typically made with polymers like nylon and "catgut", or with steel. The utility of a metallic vs. a polymer core is normally dictated by the maximum cumulative tension that the instrument can sustain with all strings tuned to pitch. The form of a typical wound string of the present invention is generally shown in FIG. 1 with portions 11 and 12 magnified in FIGS. 4 and 6. The wound string 13 of FIG. 1 is composed of a "ball end" 14 (FIG. 3) which serves to anchor the string to the bridge support 3. A magnified view is provided in FIGS. 2 and 3 which depicts one type of bridge for a conventional guitar. The ball end 14 is placed inside a hole which is drilled in the supporting structure 3 of the bridge saddle 2, and is then secured behind the bridge with a bridge pin 10. As shown in FIG. 3, the string 13, bends over the bridge when it is placed under tension.

Figure 4:
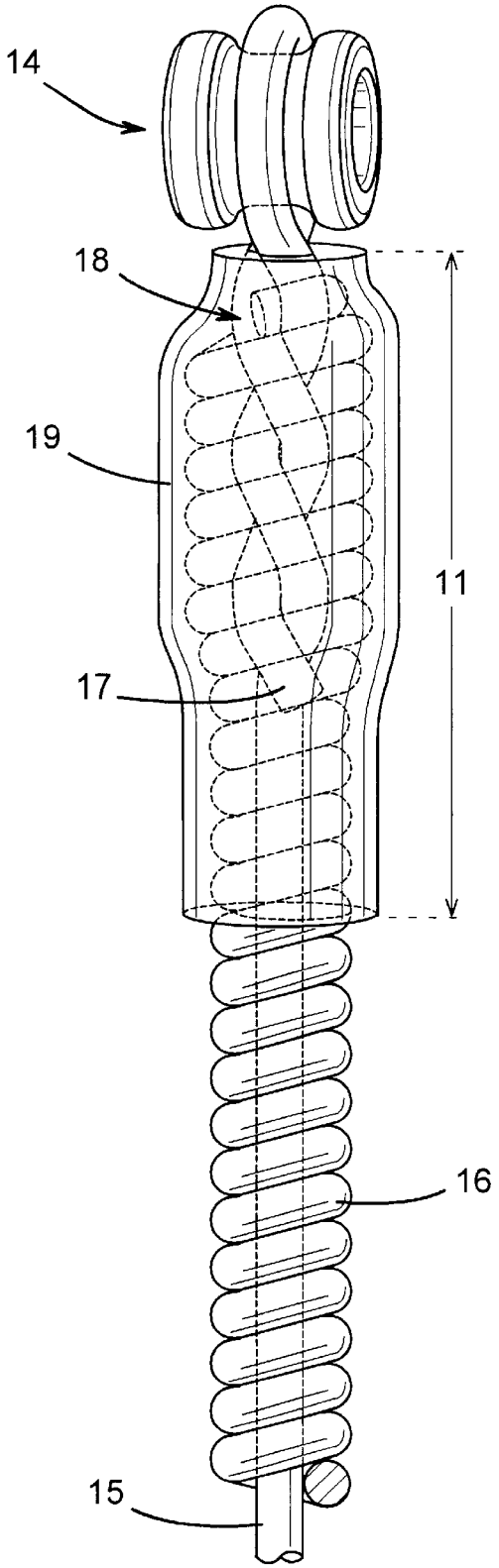
FIG. 4 shows a side elevation view of a section of the string, which illustrates the preferred form of the present invention at one end of the string, herein termed the "ball end".
Figure 5:
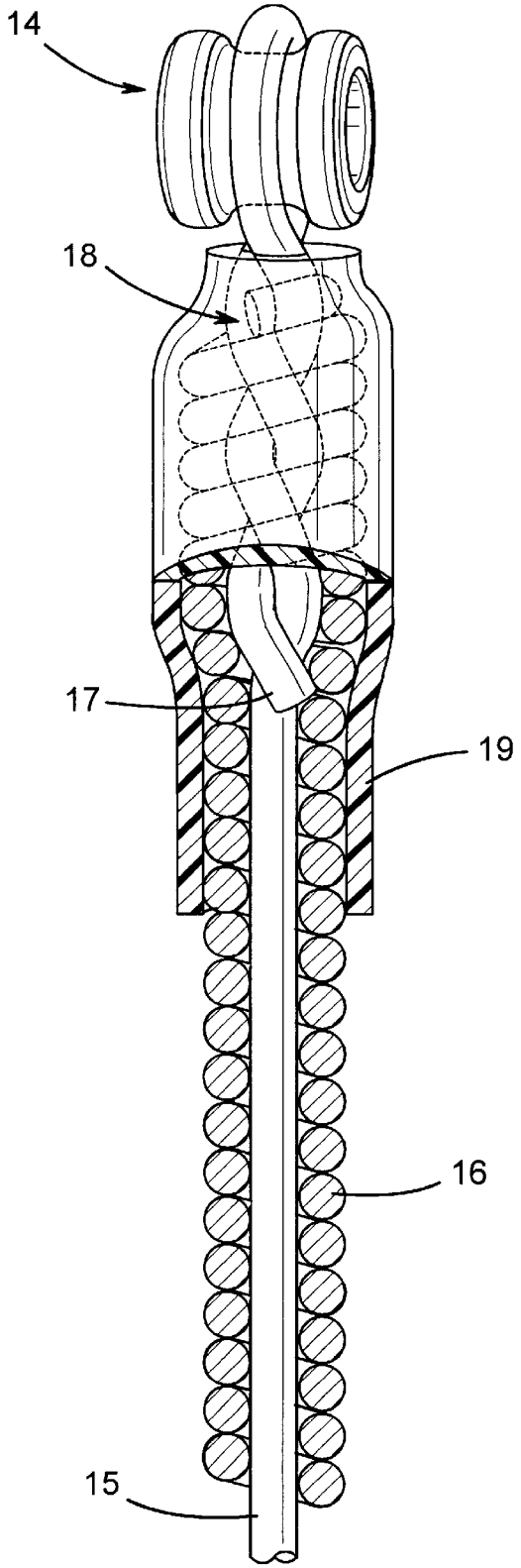
FIG. 5 shows a cross sectional view of the string shown in FIG. 4.
Figure 6:
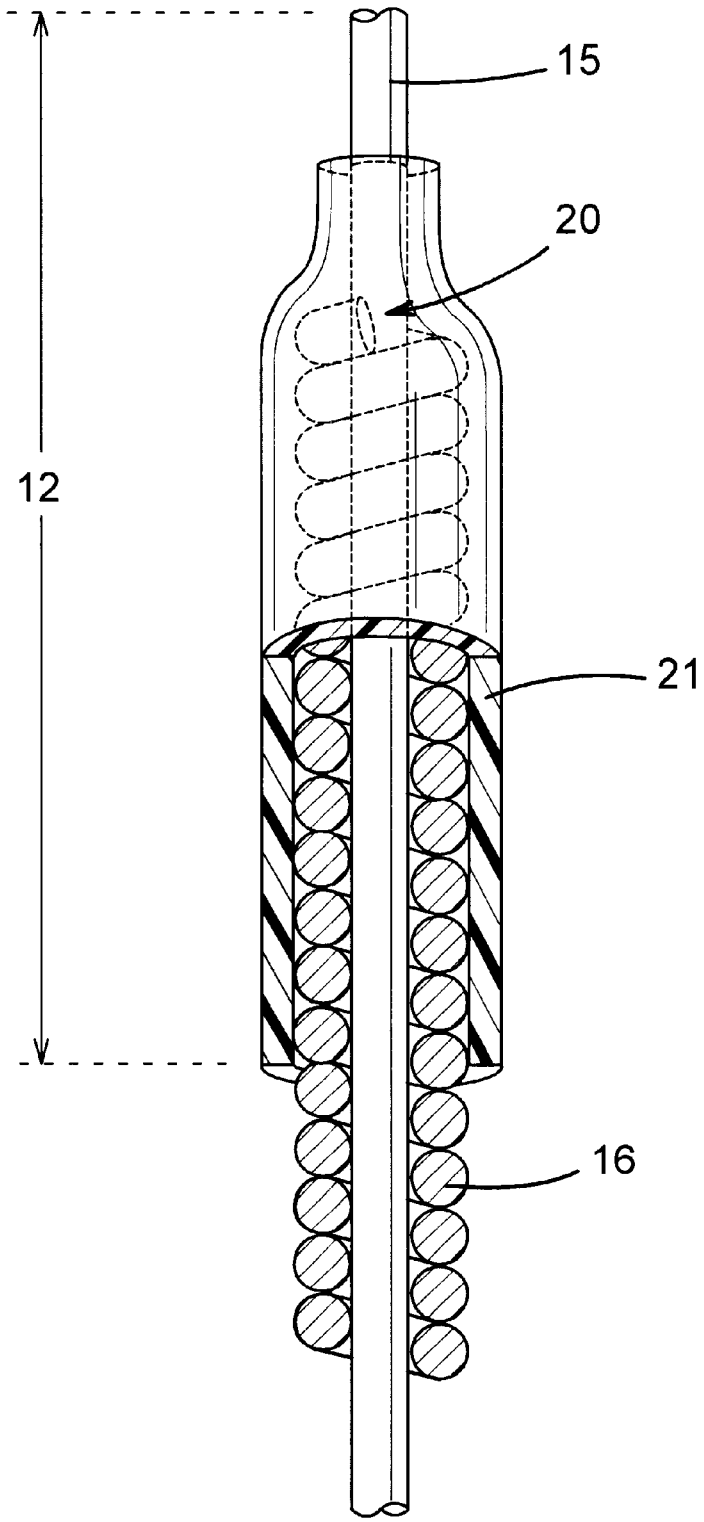
FIG. 6 shows a side elevation view of a section of the string, which illustrates the preferred form of the present invention at one end of the string, opposite the "ball end".

The wound string 13 is composed of a core 15 and a spirally wound "winding" or wrapping wire 16 as shown in the magnified views of FIGS. 4, 5 and 6. The core is looped around the ball end 14, and is then wound around itself up to a point 17, referred to here as a "transition point". The winding is mechanically attached to the loop 18, and then is spirally wound around the looped region, over the transition point 17, and over the remainder of the core 14.

The transition point 17 creates a problem with conventional wound strings since windings can slip at this point when tension is applied to the string. Also, the looped region of the core between 17 and 18 can slip when the core 15 is placed under tension. These problems result in unstable tuning, and eventually in deterioration of tonal qualities. The slippage of the wound helix over the larger diameter transition point 17 leads to a loose helix over the smaller diameter core, which can eventually propagate over the entire speaking length of the string. Hence, as with any source of loose windings, this slippage can eventually lead to an increase in the degree of vibrational dampening from frictional losses, which occurs during vibration of the string.

Slippage of the looped region about the core can also be a problem with non-wound strings, since any slippage over this region leads to stress relaxation and unstable tuning when the string is placed under tension. The entire looped region between 17 and 18 (by virtue of its larger diameter) is also more stiff than the remainder of the string, so that when the string is placed under tension, the string tends to bend at the transition point 17, which not only leads to winding slippage, but also to high localized stress on the supporting structure 3 of the bridge. For most acoustic guitars and for many other acoustic instruments, this supporting structure is typically made of wood, which is softer and lower in modulus than the metallic string. Hence the high tension of tuning combined with the localized stress imparted by the looped region of the string leads to "grooving" and excessive wear of the wood.

In order to address these problems, this invention makes use of a lower tension string as well as an outer sheathing 19 which encapsulates the area 11 over the transition 17 to prevent winding slippage, to prevent loop slippage, and to protect the supporting structure 3 of the bridge saddle 2 from high localized stress, which otherwise leads to "grooving" and excessive wear. This sheathing can be used together with any combination of metallic, composite, or polymeric string materials, and with any string construction. The greatest benefit of the sheathing is achieved when it encapsulates the entire looped region 11 which extends over the transition point 17 by a distance no greater than that required to keep the sheathing behind the bridge saddle 2, and outside the speaking length 9 of the string when it is placed on a musical instrument. In this way, the sheathing serves to secure the looped region and the windings near the transition point, so as to prevent slippage without altering the tonal characteristics of the string. Although the sheathing could be made of sufficient length to extend over the bridge saddle, it is preferred that the sheathing reside behind the bridge saddle and outside the speaking length, since it would otherwise affect the mass and damping characteristics of the string, both of which influence the tonal characteristics.

Although many materials could conceivably be used to create a sheathing, the number of feasible materials will be limited by both mechanical property and fabrication considerations. For example, materials could include concentrically wound wires, metal sleeves or swage of the type that can be crimped or metallurgically bonded in place, metallic alloys as those used in brazing or electroplating processes, or inorganic materials such as those applied in plasma or ceramic fabrication processes. However, the preferred material in this invention is an organic polymer, since such a material can not only serve to secure the windings about the looped region, but can also serve to protect the wood of the musical instrument from the high localized stress imparted by a string under tension.

It can be appreciated that a number of polymeric materials might be useful for this purpose. However, the preferred polymer is one which has the combined attributes of high yield strength, high tensile strength, low elongation under tension, and ease of processability. Examples of such materials include but are not limited to semicrystalline polymers such as polypropylene, polyethylene, polyesters, or nylons; and amorphous polymers including but not limited to polystyrene and its copolymers, polyvinylchloride and its copolymers, polyurethanes, polyvinylalcohol and its copolymers, polyvinylacetals, and polyacrylates, etc.

Such polymers could conceivably be applied to the string via conventional polymer process methods including but not limited to UV curable coating processes, water borne or solvent borne coating processes, or injection mold processes. However, a preferred method for the purposes of this invention employs the use of a heat shrinkable tube or filament which can be slid or wound over the looped region 11 of the string, and can then be shrunk with either localized heating of the structure, or through heating of the entire string. Heat shrinkable tubes or filaments can be made of materials such as nylon, polyvinyl chloride, polyolefins, neoprene, polyvinylidene chloride (Kynar), and Teflon, etc.; with the most preferred material being one that has both high yield strength, and high tensile strength.

An example of one suitable material is a heat shrinkable tube of Kynar, having an inside diameter before shrinkage of sufficient size so that it can be slid over the string, and a sufficient inside diameter after shrinkage so that the windings are tightly gripped during end use. The outside diameter after heat shrinking can be as large as is allowed by the limitations in design of the bridge pin, while simultaneously imparting stiffness to the overall structure no greater than that which would prevent the string from bending over the bridge when the string is placed under tension.

Examples of suitable outer sheathing materials include commercially available heat shrinkable tubes of polyvinylidene fluoride (Kynar) such as Daflex SH350-3/64 or Daflex SH350-1/16 from Daburn Electronics and Cable Corporation. An example of another suitable outer sheathing material is a nylon filament such as Stren from duPont, which upon heating can exhibit longitudinal shrinkage and fusion; and can thereby tightly grip the inner windings when it is concentrically wound and fused around the looped region 11, and around the transition point 17 of the string. These materials can be used to encapsulate the ball ends of wound and non-wound strings alike, thus providing the benefits of this invention to a plural set of strings for use on musical instruments.

Another problem with conventional wound strings arises as a result of winding wire slippage which originates at the opposite end of the string. The winding material of a conventionally wound metallic string is typically cut during the winding process before the end of the core is reached, resulting in a second "transition point" 20 as shown in FIG. 6. Over time, or immediately after manufacture, slippage between the winding and core can occur at this transition point 20 in part from recoil stress, and in part from interfacial corrosion that weakens the interface between winding and core. Furthermore, corrosion at the interfaces can lead to interfacial weakening anywhere along the string length, and thus can lead to winding slippage over time.

It is known that the tonal qualities of a conventional string can deteriorate as a result of frictional losses from interfacial shearing motions that occur during string vibration. Thus, it is desirable to maintain winding tightness about the core both during the process of manufacturing, as well as in end use. This problem is addressed in the construction of conventional strings through the use of polygonal shaped cores, and through the use of soft, ductile materials such as tin coatings, which serve to grip the winding as well as to protect the core from corrosion during end use. However, corrosion is not entirely prevented, and as a result, interfacial contamination and weakening occur both during storage and during end use, both of which lead to the potential for winding slippage and interfacial frictional losses during string vibration. Also, depending on the degree of spring temper in the metallic windings, the torsional recoil stress from the winding can further contribute to this problem both during manufacturing and in end use.

In order to address the problems associated with winding slippage near the transition point 20, one aspect of this invention makes use of an outer sheathing 21, which like the outer sheathing 19 near the ball end, tightly encapsulates the winding and the core over the transition point 20, thus preventing the winding from slipping during manufacture and in end use. It is preferred that the sheathing be above the nut in region 12 as shown in FIG. 1. In this way, the sheathing maintains winding tightness without interfering with the tonal characteristics of the string.

The preferred materials for the outer sheathing material 21 are the same as those described for the sheathing at the ball end, with the preferred processes for manufacture also being the same. For example, materials could include concentrically wound wires, metal sleeves or swage of the type that can be crimped or metallurgically bonded in place, metallic alloys as those used in brazing or electroplating processes, or inorganic materials such as those applied in plasma or ceramic fabrication processes. Preferred materials in this invention are polymers of the types described previously. As with the ball end sheathing, the heat shrinkable tubular polymer or filament 21 should be shrunk to tightly grip the inner composite structure. The diameter of the resultant structure after shrinking should also be small enough to still allow the end of the string to fit through the hole of a conventional tuning post. The length of the encapsulated region 12 should be long enough to simultaneously grip the wound string 13, the transition point 20, and the core outside the transition region 15, while preferably being outside the speaking length of the string.

Shrinkage of the tubes or filaments that comprise the outer sheathings 19 & 21 of this invention can be accomplished either during or after completion of the winding process; and via convection heating of the string; or -via resistive heating of the windings, the core, or both. The heating process can also be localized to the regions 11 & 12 which are to be encapsulated, or heat can be applied to the entirety of the string. The heating can be made to occur during the winding process with the use of conventional winding machines that are otherwise modified to provide some means of heating either during or after the winding of the wrap wire. In such a case, heat shrinkable tubes can be slipped over the core before it is inserted into the conventional winding machine. The core, preferably with a pre-applied ball end 14, could then be affixed to the winding machine, and conventionally wound under tension with a wrap wire over the length of the string up to a point 20 where the winding is cut; and preferably before reaching the heat shrinkable tubes which otherwise loosely encircle the core. At that point, the tubes could then be slid into positions 11 & 12 while the string is still under tension; with one tube encircling the looped region 11 near the ball end, and the second encircling the transition region 12 opposite the ball end. The tubes could then be heat shrunk, and after sufficient cooling, the entire structure could then be removed from the winding machine.

In place of heat shrinkable tubes, a heat shrinkable filament could be concentrically wrapped around one or both ends over regions 11 & 12 while the string is under tension, and heat could be similarly applied to induce the requisite fusion and shrinkage of the filament. The entire structure could then be removed from the machine. The application of heat shrinkable tubes or filament windings can also occur after the conventional winding step, in which case the wound string is first removed from the machine, the tubes or filaments are then slipped or wound into position, and the entire string or a section is exposed to heat via any of the means described above.

In one embodiment, Kynar tubes are slid over a prewound string as shown in FIG. 1, and the entire string assembly is heated in a convection oven at a temperature ranging from approximately 320° F. to 400° F., for a time necessary to achieve adequate shrinkage as judged by the tightness of the sheathing around the wound structure. A typical condition found to be adequate for the purposes of this invention involves heating the entire string at 375° F. in a convection oven for three minutes. The annealing time and temperature can be extended to any time or temperature beyond that which is required for shrinkage if such annealing is desirable for other reasons, but only to the point where degradation of the polymer does not become a problem. Conversely, the annealing time can be decreased as temperatures are elevated, and/or as thermal transfer is made more efficient; as long as adequate shrinkage/fusion is achieved within the said time period.

Figure 7:
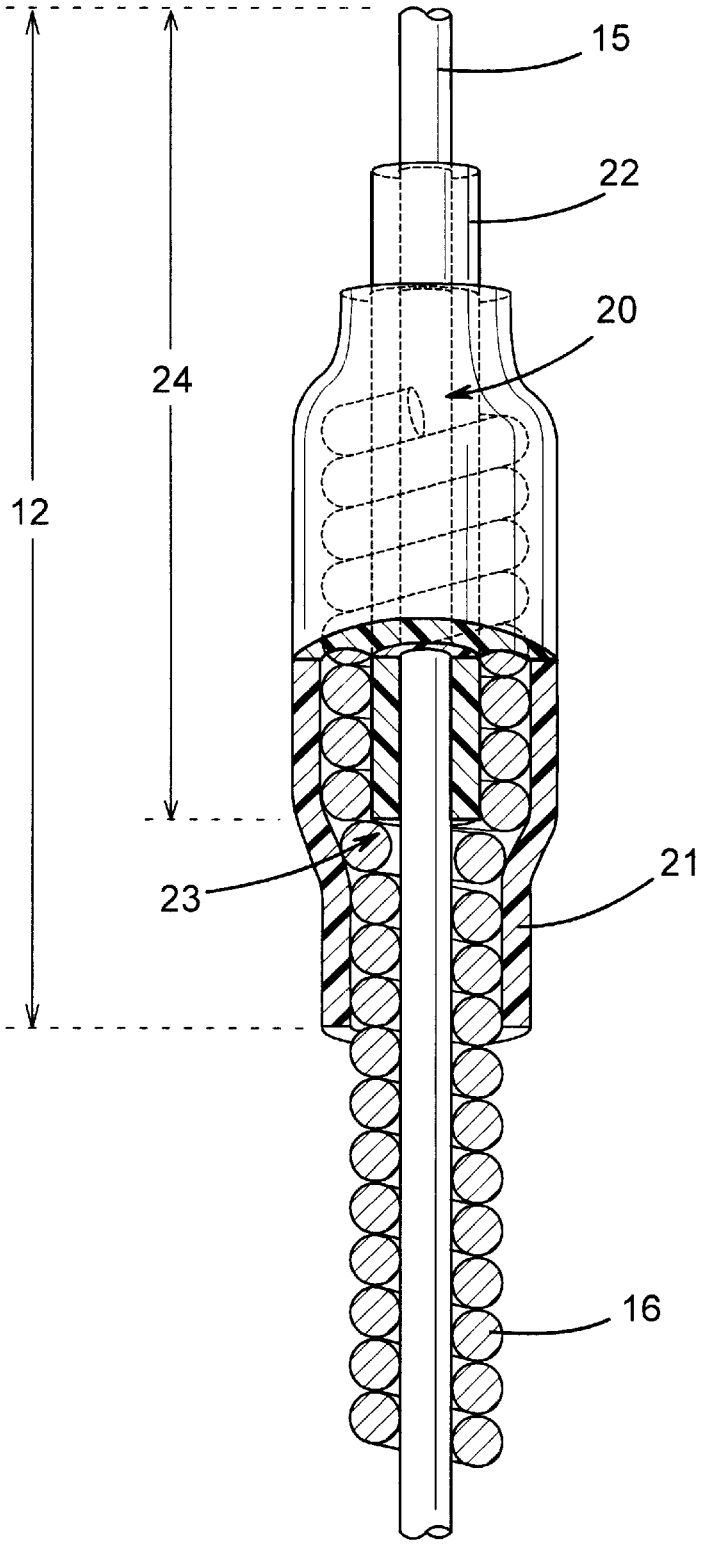
FIG. 7 shows a side elevation view of a section of the string, which illustrates another form of the present invention at one end of the string, opposite the "ball end".

Although the above methods are preferred for maintaining tight windings in this invention, there are other optional methods which can be similarly employed either separately, or in combination with the aforementioned methods. For example, an inner sheathing 22 of a heat shrinkable tube, a filament winding, or a coating could be applied to the core as shown in FIG. 7. The outer sheathing 21 is optional with this approach, but if used, it is preferred that it cover the transition point 20 as well as the second transition point 23 to prevent winding slippage.

The inner sheathing 22 can be made of the same materials as those previously described for the outer sheathings 19 & 21, or it can be made of a low modulus, low-creep, and non-damping elastomeric polymer; in which case the elastomer can either be cross linked or thermoplastic; and pre-fabricated either as a tube or as a filament. If an elastomeric or nylon filament is used, the inner sheathing 22 is first wrapped around the core over the region 24 as shown in FIG. 7. The polymeric filament can be tied to the core before and after winding if it is a thermoset; and optionally tied or fused if it is a thermoplastic. In addition, the filament could be wound as a thermoplastic, and then cured and cross-linked during a subsequent heating step. Examples of these types of inner sheathing materials include nylon monofilament (Stren from duPont), or extruded fibers of thermoplastic elastomers such as styrene-ethylene-butylene-styrene triblock copolymers (Kraton from Shell). After application of the inner sheathing 22, the metal winding 16 can then be wound around the entire speaking length 9 of the core 15, and then concentrically over the transition point 23, and up to the transition point 20, where the metal winding is cut before it reaches the end of the inner sheathing 22. The outer sheathing 21 can then be optionally applied over the entirety of the region 12 which encompasses the transition points; and if necessary, the string can be heat processed as previously described.

The advantage of the optional inner sheathing 22 is that it increases the coefficient of friction between the winding and the core, and thus helps to prevent winding recoil during manufacture and during end use. If an elastomeric inner sheathing is used, it should be of sufficient modulus to allow it to compress under the stress of the metal wrap wire 16, so that it fills the interstitial spaces between the windings and the core, and thus helps to minimize winding slippage.

If an inner sheathing of nylon filament is used, the string can be heated by methods as described above to shrink the nylon longitudinally, and to expand the nylon radially, so that it tightly grips the core, fuses, and fills the interstitial spaces between the core and windings. Thus, the longitudinal shrinkage and radial expansion characteristics of nylon filaments are desirable attributes, which can be used advantageously in one aspect of this invention to maintain winding tightness over time.

Although it is preferable for the inner sheathing 22 to reside outside the speaking length 9 of the string, an inner sheathing of nylon can be made to traverse the entire speaking length of the string, and the metal winding 16 can be concentrically wound around the inner sheathing over the entire length of the string. The string can then be heated by methods as described above to shrink the nylon longitudinally, and to expand the nylon radially, so that it tightly grips the core and fills the interstitial spaces between the core and windings along its entire length. In this way, tight windings can be maintained, and in addition, the diameter of the string can be increased without greatly affecting the mass or the tension of the string when tuned to an otherwise equivalent pitch.

The polymeric inner sheathing 22 of this invention can also be formed by dip, spray or continuous coating of a thermally or photo-curable reactive liquid of solvent borne, water borne, neat monomeric or oligomeric polymer precursors, followed by subsequent thermal or photo cure of the chosen precursors. The inner sheathing can also be formed by dip, spray or continuous coating of a water based latex polymer, a lacquer based polymer, or a fusible plastisol polymer, followed by subsequent drying, fusing or curing of said polymer.

It can be further appreciated that the preferred outer sheathing 19 & 21 of this invention can be used in any combination with inner sheathings as herein described, in any number of possible combinations, where the most preferable approach is to use such sheathings, whether polymeric or metallic, outside the speaking length 9 of the string, so as to not affect tonal characteristics of the string.

Thus in its preferred form, the aforementioned methods of maintaining tight windings during end use can be used in combination with a variety of conventional metal string materials including steel, stainless steel, nickel, nickel alloys, and copper alloys, etc. to improve the longevity and end use performance of strings composed of such materials. However, the improvements made possible by these embodiments, although exceptional themselves, do not address the other fundamental problems that affect the longevity and tonal characteristics of conventional metal strings.

For example, another serious problem with conventional steel core strings is that they tend to corrode over time; both during storage and in end use. Although several technologies have been employed in the past to help prevent corrosion (i.e. polymer coatings, ductile metallic coatings, etc.), these technologies have only served to slow the corrosion rate, but not to prevent it. Also, these technologies often make use of coatings that traverse the entire speaking length, which can lead to modulation or dampening of the tonal characteristics.

Corrosion can also mechanically weaken the string; and it can eventually lead to contamination and winding slippage, both of which deteriorate sound quality and ultimately lead to what musicians recognize as a "dead" string. In addition, steel core strings require high tensions to maintain pitch, which places considerable stress on the bridge, and on the entire top face of the musical instrument.

In order to address these issues, another aspect of this invention makes use of a more cathodic metal core than either steel or its alloys. Of equal importance, this invention makes use of a winding for wound strings, where the difference in electrochemical potential between the preferred core and winding is as close as possible to zero; and where the core is preferably the more cathodic member of the construction.

It is known that steel cores can readily corrode upon atmospheric exposure, and that corrosion is accelerated during end use. It has also been noted that corrosion can be even more severe if after initial string use, the instrument is allowed to remain idle for long periods of time. Although it has not necessarily been appreciated by others skilled in the art, it can be seen that the steel cores of conventional string constructions are relatively anodic when compared to a saturated calomel reference electrode, and that they are also more anodic than conventional metallic windings. Thus, string corrosion can be accelerated through galvanic action in the presence of moisture and salts of the type that originate from hand contact during instrument use. Although not wishing to be bound by any single theory, it is believed that this is why the corrosion rates of many conventional steel core strings are readily accelerated during end use. It has been discovered that a much improved string results when the string is constructed with the objective of minimizing, or preferably eliminating the potential for galvanic coupling between the winding and core.

Moreover, since the surface area of the core is less than that of the wrap wire of a conventionally wound string, and since the steel core is typically the more anodic member of the couple, it is surprising to find that most steel core strings have been designed with an unfavorably low anode to cathode surface area ratio, which is believed to further accelerate corrosion. Of equal surprise, it has been found that when steel cores are coupled with windings of similar electrochemical potential, galvanic corrosion is not deterred. In fact, the benefit of matching the galvanic potential between the winding and the core has only been observed when the core is more cathodic than steel. Thus, it has been found that achieving an electrochemical match between winding and core is not in itself sufficient to prevent corrosion. Hence, it is believed that the core should be both more cathodic than steel, and that the surface area ratio between anode and cathode should be maximized to slow the corrosion rate. Only then can the maximum benefit of matching galvanic potentials be realized.

In a preferred embodiment, a titanium alloy core has been found to be uniquely suited for producing a truly corrosion resistant wound string. It is generally known that titanium and its alloys exhibit exceptional corrosion resistance. In fact, this attribute makes these materials particularly well suited for the construction of non-wound strings. However, it has been found that even though titanium has exceptional corrosion resistance by itself, this does not guarantee that a wound titanium alloy core string will also have exceptional corrosion resistance. For example, unlike steel core strings, the best corrosion resistance of a titanium core wound string is achieved when its galvanic potential is closely matched to that of the winding. Thus, if the mismatch in galvanic potential is too high, the string's corrosion resistance will be poor, in spite of titanium's excellent reputation as a corrosion resistant metal.

Furthermore, although titanium can be used to produce corrosion resistant cores for wound and non-wound strings, the achievement of exceptional corrosion resistance is not in itself sufficient for the production of a musical instrument string. For example, commercially pure titanium is sufficiently corrosion resistant, but like many other metals, it does not exhibit the required tensile strength for use as the core of a musical instrument string. Since the core supports most of the tensile load during end use, it must possess a unique combination of properties including high yield strength, high tensile strength, low elongation, and minimal stress relaxation during use. Although many metals can be cold worked to enhance their tensile strengths, few can sustain the tensile loadings required for maintaining tuning at pitch over long periods of time.

In order to address these problems, the preferred metal for the core of the wound and non-wound strings in this invention is a titanium alloy, which has been surprisingly found to combine the attributes of corrosion resistance with high tensile strength, high yield strength, and low stress relaxation; all of which make the alloy uniquely suited for use as the core in wound and non-wound musical instrument strings. Certain metals when alloyed with titanium serve to stabilize and favor the formation of the beta crystalline phase over the alpha phase, which further strengthens the material. For example, titanium alloys of various beta phase fractions are often used to replace steel in aerospace applications where low density and high strength are required; but replacements are seldom made on an equivalent volume basis. In fact, because of titanium's lower modulus, larger volumes are often required to maintain stiffness and strength.

In contrast to applications where weight savings are paramount, musical instrument strings are typically constructed with higher density metals, since such metals are known to have a greater affect on vibration attenuation at equivalent spatial volumes. Further, the maximum tensile strength that can be achieved even with the best titanium alloy is startlingly less than that of steel cores, which are otherwise manufactured to conform with ASTM 228 specifications. Yet surprisingly, a properly alloyed titanium metal has been found to sustain the stress of conventional tunings. Paradoxically, it is the low density of the titanium alloy that enables it to be used in this application; since the resultant lower tension leads to a lower tensile stress at pitch than would otherwise occur with higher density metals of equal diameter and tensile strength. Finally, this is one unique application where an equivalent volume substitution can be made, and is in fact desirable since lower string stiffness can be simultaneously achieved.

Plural sets of titanium alloy core strings also exhibit lower cumulative tensions when tuned to conventional pitch values. This translates to less stress on the body of the musical instrument, and less stress on the wood bridge, which when combined with other embodiments of this invention, results in even less instrument wear over time. Hence, in order to achieve low tension from a plural set of strings, it is preferred that as many of the strings as possible be constructed with titanium alloy cores. Since higher note non-wound strings experience the highest tensile stress values, it is desirable that the titanium alloy cores exhibit minimum ultimate tensile strength values (UTS) which are greater than the tensile stress experienced by the highest note string. Thus, the minimum ultimate UTS for a titanium alloy guitar string is preferably 140 ksi, which can be achieved by cold working any of several titanium alloys, many of which are described in ASTM B863. More preferable are alloys that have received cold work combined with solution heat treatments, which together increase the fraction of the beta crystalline phase in the alloy to produce a minimum UTS of 160 to 180 ksi. Equally preferable are titanium alloys which have been cold worked, solution heat treated, and subsequently heat aged under inert atmosphere or vacuum to produce a minimum UTS of greater than 200 ksi. One alloy which has been found to be suitable for use in this application is a titanium beta-C alloy from Dynarnet Corporation, which has been cold worked and solution heat treated to achieve a minimum UTS of approximately 175 to 180 ksi.

In addition to improved corrosion resistance, and lower tension at pitch, a titanium alloy core also results in a string which is less stiff than conventional steel core strings at equivalent core and winding diameters. This attribute translates to easier fretting and playability, as well as reduced fret wear over time. It is also believed that this attribute leads to a string with better tonal quality, which in accordance with theory is characterized by fewer dissonant harmonic tones. The preferred diameter for a titanium alloy core is largely a function of instrument design. However, in order to realize the benefits of equal or lower stiffness, it is preferred that the titanium core radius be no greater than approximately 0.003" larger than the radius of a comparable steel core for any equivalent instrument design and string pitch. Larger diameters can be used, but the stiffness will increase, and the tonal quality can become less desirable. The lowest possible diameter for a titanium alloy core is dictated by the tensile strength of the material, and the tension at pitch. In general, the minimum diameter should therefore be large enough to sustain tuning without yielding or breaking.

The preferred windings for the wound strings of this invention are determined in part by the corrosion resistance of the wound construction, and by the intended end use application. In order to achieve the best corrosion resistance, the preferred winding is one with a galvanic potential that closely matches titanium. In one preferred form, the wound string is made with a titanium winding of equivalent galvanic potential to the preferred titanium alloy core. In this way, optimal corrosion resistance is combined with low tension at pitch, which enables this string to be used in plurality on low tension instruments such as classical guitars. The titanium winding of this embodiment is preferably one with sufficient ductility to enable fabrication with conventional spiral winding machines. One example of a suitable winding metal is commercially pure titanium which is either fully annealed or cold worked.

In a second preferred form, the wound string, is made with a nickel or nickel alloy winding of nearly equivalent galvanic potential to the preferred titanium alloy core. If the wound strings of this embodiment are intended for use on instruments with magnetic pickups, it is preferred that the winding be ferromagnetic, in which case the most preferred winding is pure nickel since it leads to a string with the best corrosion resistance.

Yet another embodiment of this invention is a plural set of metallic strings for use on low tension instruments such as classical guitars. In this case, the preferred core for the bass or wound strings is a titanium alloy, and the preferred core for non-wound strings is either a titanium alloy, or a polymer such as nylon. The preferred winding for the wound strings is again titanium, but any material of sufficiently low density could be substituted, as long as the corrosion resistance and other attributes are not adversely affected.

In another embodiment, a plural set of strings for use on instruments with magnetic pickups makes use of the preferred alloy core together with ferromagnetic windings for the wound strings, and ferromagnetic materials such as steel for the non wound strings. In this way, low cumulative tension can be achieved together with conventional amplification through magnetic pickups.

Although the best corrosion resistance is achieved when the galvanic potential of the winding wire matches that of the preferred titanium alloy core, more anodic windings can be used if they are desired for other attributes such as processability, or tonal characteristics. In such cases, the corrosion resistance of the resultant string can be enhanced through surface treatment of the winding wire either before or after the string is wound. If a copper alloy such as phosphor bronze is chosen as the winding, the corrosion resistance of the resultant wound string can be improved by treating the surface of the alloy with a compound from the azole family, including but not necessarily limited to triazoles and imidazoles such as 5-methyl-1H-benzotriazole, 4-methyl-1H-benzotriazole, 1H-benzotriazole, benzimidazole, 5-methylbenzimidazole, 2-methylbenzimidazole, 1-methylbenzimidazole, carboxylic functional triazoles etc. This surface treatment can be applied to the winding during its fabrication, during the string fabrication, or after the string has been manufactured. The total molar surface concentration should be kept to a minimum, but not less than that which is required for surface coverage of the winding wire. Typical surface concentrations can range from 5 $\mu$mole/m$^2$ to 100 $\mu$mole/m$^2$. Thus, if the surface treatment is to be applied via a water based solution as in the case of certain azoles such as carboxylic acid functional triazoles, or from an alcohol solution as in the case of other azoles such as benzimidazole, the solution concentration should be sufficient so as to allow for adequate surface coverage within the confines of the process residence time and temperature. For example, a winding wire can be dipped into a 1% by weight solution of benzimidazole in a mixture of ethanol and water for various amounts of time, depending on the temperature and the degree of surface coverage required. The winding can then be air dried before it is wound, or drying can be accomplished during winding. It can be appreciated that equilibrium absorption rates and therefore process times can be adjusted by changing the concentration of the azole compound in solution, by changing the temperature, by modifying the pH of the medium, and by controlling the drying rate. It has been found that such treatments on conventional phosphor bronze windings result in excellent corrosion resistance when the windings are combined with the preferred titanium alloy core. In the absence of such treatments, the corrosion of a phosphor bronze winding is actually accelerated by the presence of titanium. These results are surprising, especially in light of the fact that the identical surface treatment was found to have little to no effect on the corrosion resistance of the same phosphor bronze windings when they were wound on conventional steel cores.

The preferred cores and windings of this invention can be made into strings by methods common to the art; including batch methods, where spiral winding is accomplished through torsional rotation of the core; or through continuous processes where a core is helically wrapped via a rotating assembly. In both cases, the equipment can be modified to allow for resistance heating during or after winding, convection heating during or after winding, surface treatment during or after winding (over either a portion of, or over the entire string length), or plasma polymerization during or after winding. Post winding processes can include the aforementioned methods of heating as well as cryogenic treatments, plasma treatments, or batch surface treatments of other types for the purpose of enhancing corrosion resistance. The cores of the strings can be equipped with conventional ball ends either before or after winding, or they can be equipped with alternative ends such as those which can be swaged, crimped, soldered, or welded into place.

It can be appreciated that the most preferred form for the wound strings of this invention is one where the core is a titanium alloy and the winding is a metal of equivalent or nearly equivalent galvanic potential. Thus, by the very nature of this invention, ductile metal or polymer surface coatings are not required to protect the speaking length of the string from corrosion. Although such coatings could be used if desired for other attributes, they are not necessary for the purposes of this invention. Hence, the effects of such coatings on tonal characteristics can be avoided. However, in the absence of commonly used ductile coatings which include materials such as tin, silver, and gold to name a few; a method is required to maintain tight windings during manufacture, in storage, and in end use. Thus, the preferred wound string of this invention is one which makes use of a titanium alloy core 15, a winding metal 16 of equivalent or nearly equivalent galvanic potential, and two sheathings 19 & 21 positioned on both ends 11 & 12 of the string such that they are outside the speaking length 9, so as to maintain tight windings without affecting tonal characteristics during end use. The benefits of the present invention are illustrated in the following examples. The first three examples were performed for the purpose of comparison.

EXAMPLE 1

This example demonstrates the use and performance of both the non-wound strings, and the core components of the wound strings of this invention.

A titanium beta-C alloy material was drawn into the form of round wires by Dynamet Corporation of Washington, Pa. The wires were processed and verified to meet all AMS4957B minimum specifications, with ultimate properties exceeding the minimum specifications as defined below.

| wire d (inches) | alloy type | minimum ultimate tensile strength (KSI) | minimum yield stress (KSI) | % elongation at yield |
|---|---|---|---|---|
| 0.013" | beta-C; $TiAl_3V_8Cr_6Mo_4Zr_4$ | 180 | 175 | 2.7 |
| 0.018" | beta-C; $TiAl_3V_8Cr_6Mo_4Zr_4$ | 180 | 170 | 2.3 |

Samples of these wires were looped around conventional ball ends as shown in FIG. 4. Resultant strings were then strung onto 6-string acoustic guitars, each having the structural characteristics as shown in FIGS. 1, 2 and 3, including a bridge support structure 3, a bridge saddle 2, a fixed speaking length 9 of 25.5", a nut 6, and tuning posts 7.

The 0.013" diameter strings were strung in the high "E" positions 8*f*, and the 0.018" strings were strung in the "B" positions 8*e* of three guitars including a Taylor model 514-C acoustic guitar, a Hoffier model 5323 handmade acoustic guitar, and a Washburn model C40-I classical guitar. The "E" strings were tuned to the conventional 330 Hz, and the "B" strings to conventional 247 Hz with the use of a Korg AT-2 auto tuner. The resultant string tensions were calculated using equation 1, where the speaking length L=25.5", and the mass per unit length was derived from a gravimetrically measured wire density of 0.177 lbs./in.$^3$. Engineering tensile stress values were then calculated from the tension divided by the initial cross sectional area for the core of each string.

| string | diameter | tension (lbs.) | engineering tensile stress (KSI) |
|---|---|---|---|
| E, 330 Hz | 0.013" | 17.2 | 130 |
| B, 247 Hz | 0.018" | 18.5 | 73 |

The strings were monitored over a 3 month period, and exhibited surprisingly good dimensional stability as evidenced by no change in tuning over time. The strings also qualitatively maintained their tonal characteristics, even after extensive cumulative periods of play. In addition, no warping or bridge damage was observed near the bridge area of the classical Washburn guitar, as would be expected to occur with metallic steel strings.

After the initial monitoring period, the tension on the 0.013" "E" string of the Hofner acoustic was incrementally increased by half steps to pitch values of F, F#, and then G at 392 Hz. The string maintained its tuning and dimensional stability at both F and F#, but elongated and failed as the tension was increased to a tuning of G at 392 Hz. The tension at this frequency corresponded to a calculated value of 22.4 pounds, or a tensile stress of 169 KSI, which was close to the anticipated failure point of the string.

EXAMPLE 2

This example demonstrates the use and performance of a wound string made from the titanium alloy wires of example 1. A fixed length of 0.018" Ti alloy wire was affixed with a ball end as described in example 1, and was then secured within a static metal support frame, equipped with the means of fastening the string at both ends so that the string could be placed under tension during manual spiral winding. The tension on the core wire was increased to a value of approximately 17 pounds, as calculated from the speaking length of the core (the distance between the fixed ends within the metal support frame), and from the frequency of vibration of the core as measured with a Korg AT-2 auto tuner.

The 0.013" Ti alloy wire of example 1 was affixed through the loop of the ball end 14 at a starting position 18 as shown in FIG. 4. With the core under tension, the 0.013" wire was spirally wrapped in counterclockwise fashion form left to right to a total distance of approximately 32" at which point the winding wire was cut, leaving a small section of the core wire exposed at one end of the string.

The resultant 0.044" diameter wound string was then removed and strung on a Hofner acoustic guitar, and then subsequently on a Taylor acoustic in the "A" position 8*b* as shown in FIG. 1. In both cases, the string was tuned to "A" at the conventional tuning of 110 Hz, yielding a calculated tension value of 16.6 pounds and resultant tensile stress of 65 KSI in both cases. The string was played in combination with conventional steel core strings that were strung in positions 8*a*, 8*c*, and 8*d*; and with Ti alloy strings as defined in example 1 in positions 8*e* and 8*f*.

The string exhibited good tonal qualities as characterized qualitatively by its initial "brilliance" or "brightness", similar in quality to the initial "brilliance" or "brightness" of conventional wound metallic strings. Surprisingly, no adverse buzzing noises could be detected during play in spite of the low tension to diameter ratio of this wound string. This is particularly surprising with the Taylor guitar since its "playing action" was set to be the "tightest" with a distance of approximately ⅛" between the open strings and the 12th fret.

EXAMPLE 3

This examples serves to compare the performance of the titanium alloy strings of examples 1 and 2 to a conventional phosphor bronze wound steel core string. John Pearse medium, phosphor bronze wound acoustic strings, were purchased for this example. The six string set was strung on the Taylor acoustic of example 2, and all strings were tuned to conventional tunings. Tensions as shown below were calculated based on measured densities of 0.322 lbs./in$^3$ and 0.300 lbs./in$^3$ for the windings and cores respectively; measurements of core and winding diameters; and speaking lengths of 25.5" for each string.

| string | overall diameter (inches) | calculated tension (lbs.) | engineering tensile stress (KSI) |
|---|---|---|---|
| E, 82 Hz | 0.056 | 29 | 112 |
| A, 110 Hz | 0.045 | 34 | 159 |
| D, 147 Hz | 0.035 | 37 | 200 |
| G, 196 Hz | 0.026 | 36.5 | 235 |
| B, 247 Hz | 0.017 | 28 | 123 |
| high E, 330 Hz | 0.013 | 28.5 | 220 |

When tuned to conventional pitch on the Taylor acoustic, the strings exhibited the characteristic tonal "brilliance" expected from new strings, with no evidence of buzzing noises or other unpleasant resonances.

The "A", "B" and "high E" strings were then subsequently tuned to lower pitch values for the purpose of achieving tensions similar to those achieved with the Ti alloy strings of examples 1 and 2. The strings were plucked and qualitatively compared for buzzing and other unpleasant resonances at reduced tensions. The results are given below.

| string | tuning frequency (Hz) | tension (lbs.) | result |
|---|---|---|---|
| John Pearse "A" | 73 | 15 | severe buzzing |
| " | 82 | 19.2 | moderate buzzing |
| " | 98 | 26.6 | no buzzing |
| John Pearse "B" | 165 | 12.5 | moderate buzzing |
| " | 196 | 17.9 | slight buzzing |
| " | 220 | 24.8 | no buzzing |
| John Pearse "E" | 220 | 12.7 | slight buzzing |
| " | 247 | 16.3 | no buzzing |
| " | 308 | 24.9 | no buzzing |

The John Pearse strings of this example are comparable in diameter to the Ti alloy strings of example 1 and 2, yet unlike the Ti strings, they produce more unwanted noises and vibrartions at similar reduced values of tension, with the wound "A" string producing the most pronounced difference. Thus, unlike the Ti alloy strings of examples 1 and 2, the vibrational and tonal characteristics of equal diameter strings constructed of conventional materials are not suitable for use at reduced tensions when strung on an otherwise identical acoustic body guitar.

EXAMPLE 4

This example illustrates the negative effect of loose windings on tonal quality, and the improvement that can be realized when the windings are held tightly in place about the core.

A smooth, 0.017" diameter round "silvered steel B" string was taken from a commercially purchased D'Addario medium gauge acoustic set, and was wound with 0.013" Ti alloy from example 1 via methods described in example 2. At the end of the winding process, the Ti alloy wrap wire was cut, resulting in a noticeable winding recoil characterized by a partial radial expansion, loosening, and longitudinal retraction of the wrap wire by a distance of approximately 1" along the core. The resulting string, having an overall d=0.044", was strung in the "A" position of a Hofner acoustic guitar, and was tuned to 110 Hz. During subsequent play, the string produced undesirable buzzing noises, and exhibited tonal qualities characteristic of a "dead" or highly dampened string.

Without removing the string from the guitar, the tension was reduced so that the string could be lifted by hand from the nut of the guitar. At that point, the windings were hand tightened by rotating them over the core while maintaining a torsional stress sufficient to prevent recoil. The string was then held under pressure by hand against the nut to again prevent recoil, while it was subsequently re-tuned to pitch. At that point, the string was struck and played for the purpose of qualitatively comparing its tonal characteristics to those observed before the tightening process. Although its tonal qualities were not as good as the initial tonal qualities of the string produced in example 2, the string exhibited significantly longer periods of sustain and less buzzing noise after the tightening process.

In a subsequent step, the tuning tension of the wound string was again reduced until noticeable recoil was observed to occur, at which point the torsional stress of the hand tightened windings was relieved to its original state. The tuning tension was again restored to the original pitch of 110 Hz. Once again, the string produced undesirable buzzing noises, and exhibited tonal qualities characteristic of a "dead" or highly dampened string.

EXAMPLE 5

This example also illustrates the negative effect of loose windings on tonal quality, and the improvement that can be realized when the windings are held tightly in place about the core.

After approximately 1 week of playing the Ti alloy wound Ti alloy "A" string of example 2 on a Taylor guitar, the string lost its initial "brilliant" tonal characteristics, and was characterized as having the same dampened or "dead" characteristics of the string described in example 4.

Using the methods of example 4, the tuning tension was reduced, and the windings were found to be loose near the tuning post end. The windings were similarly tightened by hand, and the string was re-tuned to pitch. The tonal characteristics were qualitatively improved, but never to the state that was achieved when the string was first fabricated.

EXAMPLE 6

This example further illustrates the effect of winding tightness on sound quality. Using the winding procedure of example 2, a 0.018" Ti alloy core was wound with a 0.0077" heat shrinkable monofilament nylon winding (Stren monofilament fishing line by duPont) over the entire length of the string. At the onset of winding, the nylon was tied to the core near the ball end in position 18. The nylon was then wound counterclockwise over the entire length, and was then knot tied around the core to hold it tightly in place at the end of the winding process. The diameter of the nylon was drawn and reduced during the winding process to yield a wound diameter of 0.029", which was less than the theoretical value of 0.034". The string was then concentrically wound with the 0.013" Ti alloy wire of example 1 to yield a string of overall diameter=0.054". At the end of the winding process, the Ti alloy wrap wire was cut just before reaching the end of the inner nylon winding, so that the inner nylon wrap was extended beyond the Ti outer wrap along the core. The entire structure was then placed in an oven at 375° F. for 10 minutes together with a small section of free nylon monofilament material.

Both samples were removed from the oven and allowed to cool to room temperature. The free nylon was found to exhibit machine direction shrinkage of −25%, and diameter expansion of +10%. Consequently, the windings on the resulting string were tight and could not be loosened by hand. The string was placed in the "E" position 8*a* of the Taylor guitar and was tuned to 82 Hz. The resultant string exhibited good tonal characteristics with no buzzing or undesirable resonances. The tension was then increased to a tuning of "A" at 110 Hz, and the sound of the string was qualitatively compared to the "dead" string of example 5 in position 8*b*. The concentrically wound string had significantly better tonal qualities with the characteristic "brilliance" of a new string, and unlike the string of example 5, it exhibited no observable change in tonal characteristics after one week. The concentrically wound string was then removed from the Taylor, and its windings were observed to still be tight about the core. The string was then re-strung in the "E" position 8*a* of a Hofner guitar; where it was subsequently monitored over a two month period, over which time no discernible difference in tonal characteristics could be perceived.

EXAMPLE 7

Using the method of example 2, a 0.0188" Ti alloy core was wound with a 0.016" diameter phosphor bronze wire (CDA 510A, 170 KSI ultimate tensile strength, hard temper, from California Fine Wire) to yield a string with overall d=0.050". As in example 4, the winding was observed to recoil after cutting. The string was placed in the "A" position of a 12 string Ovation acoustic guitar equipped with a DeArmond 230 magnetic pickup. All of the remaining positions on the guitar were strung with conventional wound and non-wound steel core strings. The "A" string was plucked and was qualitatively evaluated for both acoustic sound quality, and for amplified sound quality. The pickup was amplified by a Gorilla GC-60 guitar amplifier.

Like the string of example 4, the string of this example also produced buzzing noises when played. Also, unlike the other steel core strings that made up the plurality of the set, the phosphor bronze wound Ti string induced no response from the DeArmond pickup.

EXAMPLE 8

A 0.042" diameter "Super Slinky" electric guitar string (manufactured by Ernie Ball) was unwound under tension to yield a nickel plated metal winding having a measured density of 0.275 lbs/in$^3$, and a diameter of 0.0125". Using the method of example 2, this wire was wound around a 0.018" Ti alloy core to yield a string of 0.043" overall diameter. The string was placed in the "E" position of an Ovation 12-string guitar, and was tuned to 82 Hz. The string produced the "brilliant" tonal characteristics of a new string when played without producing buzzing noises or other unpleasant resonances. The string was also tuned to "A" at 110 Hz and similarly exhibited good tonal characteristics. Unlike the string of example 7, this string's winding was magnetic, and hence induced a response from the DeArnond pickup, which was successfully amplified with the Gorilla GC-60 guitar amplifier.

EXAMPLE 9

A used D'Addario EJ16 light phosphor bronze wound "E" string with otherwise "dead" tonal characteristics was placed under tension and was unwound to yield the free core and a 0.0175" phosphor bronze wire having a density of 0.32 lbs./in$^3$. Visual inspection of the winding under a microscope revealed dark bands encircling the perimeter of the wire in helical fashion, coincident with the prior junction points of contact between the winding and the tin coated, hexagonal steel core.

In preparation for winding, a 0.018" Ti alloy core was placed under tension as described in example 2, and a 0.020" diameter elastomeric rubber band was tied to the core and helically wound under tension around a 2" section 24 of the core opposite the ball end, and outside of the speaking length of the string as shown in FIG. 7. The elastomer was tied to the core with a simple square knot before and after winding. In this way, the elastomeric band remained under tension over the 2" span.

In spite of its surface contamination, the phosphor bronze wire was re-wound about the 0.018" Ti alloy core, and over the entire speaking length of the string using the method of example 2. The winding was continued concentrically over the inner wrap of elastomer as shown in FIG. 6 until just before the end of the inner wrap, at which point the winding was cut. The winding was found to tightly grip the elastomeric wound core with no evidence of recoil. The resultant 0.053" diameter string was strung in the "E" position 8*a* of a Taylor guitar, and was tuned to E at 82 Hz, at a calculated tension of 23.2 pounds (91 KSI). The string had brilliant initial tonal characteristics in spite of the surface contamination and the dampened tonal characteristics of the original steel string from which the winding came. The string retained good tonal qualities, and produced no buzzing during continuous use as monitored over a two month period of time.

EXAMPLE 10

Using the procedure outlined in example 9, a 0.018" Ti alloy core was wound with a 0.0126" diameter Ni 200 wire (99% nickel, 152 KSI ultimate tensile strength, number 4 hard, cold drawn, density 0.322 lbs/in.$^3$, from Millard Wireland, Inc.). As in example 9, the core was similarly wound with an elastomer opposite the ball end over which the Ni 200 wire was concentrically wound. The finished string of overall d=0.042" was strung in the "A" position of an Ovation 12-string guitar, and was tuned to A at 110 Hz (28.6 pounds tension, 113 KSI tensile stress). No winding recoil was observed, and the resultant tonal characteristics were excellent during play. Unlike the phosphor bronze wound string of example 7, this Ni-200 wound string induced a response from the DeArmond magnetic pickup, which was successfully amplified by the Gorilla GC-60 guitar amp.

EXAMPLE 11

A 0.018" Ti alloy core wire was affixed with a ball end as described in example 1. The end of the core opposite the ball end 24 was dip coated with a low Tg acrylic latex copolymer (Jones Tones Glossy Paint, Pueblo, Colo.) over a 5" section, located outside of the speaking length of the string as shown in FIG. 7. The coating was allowed to dry for two days prior to winding. The partially coated core was then placed under tension within a metal frame as described in example 2, where the spacing between the ends was fixed at 36". In preparation for winding, the tension of the core was increased until its vibration frequency (as measured with a Korg AT-2 tuner) was coincident with a calculated tension of 30.5 pounds.

A used, and tonally "dead" D'Addario, phosphor bronze wound "D" string (from an EJ16 light acoustic set) was unwound as described in example 9 to yield the free core and a 0.008" diameter phosphor bronze winding. This winding was helically contaminated with dark bands as previously described in example 9. The used phosphor bronze wire was spirally wound around the Ti alloy core as described in example 2, and was continued concentrically over the coated end as shown in FIG. 7. The winding was stopped and cut before the end of the coated core section was reached. No winding recoil was observed.

The wound string (d=0.0335") was removed from the metal frame, and a 1.5" length of heat shrinkable Kynar tubing (SH350-3/64, from Daburn Cable and Electronics Corp.) was slid over the concentrically wound region so that the transition regions 23 and 20 were completely covered as shown in FIG. 7. The string was then placed in an oven at 375° F. for 3 minutes to allow the Kynar tube to shrink over the transition area. The string was removed from the oven and was allowed to cool under ambient conditions. The windings were tightly bound to the core and could not be moved by hand over any section of the string.

The string was strung in the "D" position 8*c* of a Taylor acoustic guitar and was tuned to D at 147 Hz (tension=30.5 pounds, and 120 KSI tensile stress). The sheathed area 21 was located outside of the speaking length 9 of the string as shown in FIGS. 1 and 3A. Hence the polymers had no effect on the tonal quality of the string, but instead served to tightly hold the windings around the core during fabrication, and during end use.

The tonal characteristics were surprisingly excellent in spite of the fact that the winding wire originated from a highly dampened or "dead" sounding steel core string. This new string maintained its dimensional characteristics, its pitch, and its good tonal qualities throughout a one month period of playing and qualitative monitoring.

EXAMPLE 12

Using the procedure outlined in example 11, a 0.018" Ti alloy core wire was wound with a 0.012" 52% Ni alloy wire (commercially available from Mapes Piano String Co.). The core was similarly dip coated opposite the ball end prior to winding. The winding wire was wound over the entire speaking length and the concentrically over the coated area as in example 11. Similarly, a Kynar tube was slid over the transition regions, and the string was heated at 375° F. for 3 minutes to heat shrink the Kynar sheathing. Equivalent wound strings were also prepared using 0.012" nickel plated steel, 0.012" 430 stainless (both from Mapes), and 0.0126" Ni-200 wire (Millard Wireland). Each of these strings was characterized as having tight windings and good tonal characteristics when tuned to A at 110 Hz on a Hofnier acoustic guitar.

EXAMPLE 13

The winding procedure of example 11 was repeated with a 0.018" Ti alloy core and a 0.0126" diameter Ni 200 winding, but without the use of an inner sheathing or coating on the core. After winding, the tension was relieved and the 0.0425" diameter string was removed from the metal frame. A 1" section of Kynar tubing (SH350-1/16 from Dabum) was slid over the string to the ball end, where it encapsulated the transition point 17 as shown in FIG. 4. Another 6" length section of Kynar tubing was then slid over the opposite end of the string, where it encapsulated the transition point 20 as shown in FIG. 6. The string was then placed in an oven at 390° F. for 30 minutes, and was removed to cool under ambient conditions. The Kynar outer-sheathings 19 and 21 were successfully heat shrunk so as to tightly grip the windings around both transition points at opposite ends 11 and 12 of the string, but not within the speaking length 9.

The string was strung in the "A" position 8*b* of a Taylor acoustic guitar and was placed under tension at a tuning of A at 110 Hz. The encapsulated region near the ball end was behind the bridge saddle and under the bridge pin. The opposite encapsulated end was threaded through and wound around the tuning post, so that the entirety of this encapsulate d region was above the nut. In this way, the string windings were held tightly to the core with polymeric materials, but only outside the speaking length of the string, so that tonal properties would not be affected.

EXAMPLE 14

The following example illustrates a facet of this invention which makes it possible to produce wound and non-wound strings that are lower in stiffness than conventional steel core strings of equal overall diameter. The following table shows the maximum titanium core diameters that can be used for wound guitar strings such that the resultant stiffness values do not exceed the stiffness values from a conventional set of steel core strings, all other variables being equal including overall diameter and tuning pitch. The conventional strings used for this comparison are D'Addario EJ16 light phosphor bronze strings.

The stiffness of a cylindrical rod in bending is given by $E\pi r^4/4$, where E is Young's modulus, and r is the radius of the rod. Since the Young's modulus value for steel is approximately twice that of titanium, equivalent string stiffness would be expected at the core diameters given below.

| string | D'Addario EJ16 steel core diameter (inches) | titanium alloy core diameter at equal stiffness (inches) |
|---|---|---|
| E | 0.018 | 0.021 |
| A | 0.017 | 0.020 |
| D | 0.016 | 0.019 |
| G | 0.014 | 0.017 |
| B | 0.016 | 0.019 |
| high E | 0.012 | 0.014 |

Hence, strings that are constructed with Ti alloy cores of lower diameter than those in the above table (like those of the prior examples) will be lower in stiffness than comparable steel core strings, with the overall wound diameter being the same.

EXAMPLE 15

The following example illustrates a facet of this invention which makes it possible to produce a plural set of titanium alloy core strings that are suitable for use on instruments with magnetic pickups. The strings of this example are equivalent in overall diameter to D'Addario EJ16 light phosphor bronze wound acoustic strings, but would exhibit the benefits of equal or reduced stiffness, lower cumulative tension, and more uniform tension across the bridge, in spite of the nearly equivalent winding densities. The Ti alloy core string tensions do not exceed 128 KSI tensile stress. Calculations are based on both a 25.5" speaking length, and on the material densities as given below.

Material densities for tension calculations

| material | density (lbs./in.$^3$) |
|---|---|
| Ni 200 | 0.322 |
| phosphor bronze | 0.320 |
| Ti alloy core from example 1 | 0.177 |
| commercially pure Ti | 0.163 |
| steel | 0.300 |
| nylon | 0.042 |

Tension calculations for D'Addario EJ16 light phosphor bronze wound acoustic strings (steel core).

| | E | A | D | G | B | high E | total T (lbs.) |
|---|---|---|---|---|---|---|---|
| core d (in.) | .018 | .017 | .016 | .014 | .016 | .012 | |
| winding d (in.) | .0175 | .0125 | .008 | .005 | | | |
| total d (in.) | .053 | .042 | .032 | .024 | .016 | .012 | |
| tension (lbs.) | 25.7 | 29.3 | 30.9 | 31.4 | 24.8 | 24.9 | 167 |

Tension calculations for Nickel 200 wound Ti alloy core strings of equivalent overall diameter to D'Addario EJ16 strings, with non-wound steel core B and high E strings.

| | E | A | D | G | B | high E | total T (lbs.) |
|---|---|---|---|---|---|---|---|
| core d (in.) | .018 | .018 | .018 | .016 | .016 | .012 | |
| winding d (in.) | .0175 | .012 | .007 | .004 | | | |
| total d (in.) | .053 | .042 | .032 | .024 | .016 | .012 | |
| tension (lbs.) | 24.4 | 27 | 26.8 | 25.5 | 24.8 | 24.9 | 153 |

EXAMPLE 15A

The following example illustrates a facet of this invention which makes it possible to produce a plural set of titanium alloy core strings with the attributes of high corrosion resistance, equal and uniform tension across the instrument bridge, low cumulative tension compared to sets of conventional steel core strings with similar diameters, and suitability for use on instruments with magnetic pickups. The Ti alloy core string tensions do not exceed 119 KSI tensile stress. Calculations are based on both a 25.5" speaking length, and on the material densities as given below.

Material densities for tension calculations

| material | density (lbs./in.$^3$) |
|---|---|
| Ni 200 | 0.322 |
| phosphor bronze | 0.320 |
| Ti alloy core from example 1 | 0.177 |
| commercially pure Ti | 0.163 |
| steel | 0.300 |
| 430 stainless steel (430 st) | 0.278 |
| 52% Nickel alloy | 0.300 |
| nylon | 0.042 |

Tension calculations for mixed alloy wound Ti alloy core strings with non-wound steel core B and high E strings; suitable for use with magnetic pickups, and having equal and uniform tension across the instrument bridge.

| | E | A | D | G | B | high E | total T (lbs.) |
|---|---|---|---|---|---|---|---|
| core d (in.) | .0190 Ti alloy | .0180 Ti alloy | .0180 Ti alloy | .0171 Ti alloy | .0168 steel | .0126 steel | |
| winding d (in.) | .0185 Ni200 | .0121 Ni200 | .0075 52% Ni | .0044 430 st | | | |
| total d (in.) | .0560 | .0422 | .0330 | .0259 | .0168 | .0126 | |
| tension (lbs.) | 27.2 | 27.3 | 27.2 | 27.3 | 27.3 | 27.4 | 163.7 |

EXAMPLE 16

The following example further illustrates a facet of this invention which makes it possible to produce a plural set of low tension titanium alloy core strings, with phosphor bronze wound bass strings, and with non-wound steel strings. The overall diameters are comparable to those of John Pearse medium phosphor bronze wound acoustic strings. The Ti alloy core strings would exhibit lower cumulative tension, more uniform tension across the bridge, and lower stiffness in spite of the equivalent winding densities. The Ti alloy core string tensions do not exceed 133 KSI tensile stress. Calculations are based on a 25.5" speaking length, and material densities as given in example 15.

Tension calculations for John Pearse medium phosphor bronze wound acoustic strings (steel core).

| | E | A | D | G | B | high E | total T (lbs.) |
|---|---|---|---|---|---|---|---|
| core d (in.) | .018 | .0165 | .015 | .014 | .017 | .013 | |
| winding d (in.) | .019 | .0145 | .010 | .006 | | | |
| total d (in.) | .056 | .0455 | .035 | .026 | .017 | .013 | |
| tension (lbs.) | 29 | 34 | 37 | 36.5 | 28 | 28.5 | 193 |

Tension calculations for phosphor bronze wound Ti alloy core strings of equivalent diameter to John Pearse medium strings, with steel core non-wound B and high E strings.

| | E | A | D | G | B | high E | total T (lbs.) |
|---|---|---|---|---|---|---|---|
| core d (in.) | .018 | .018 | .018 | .017 | .017 | .013 | |
| winding d (in.) | .019 | .0135 | .0085 | .0045 | | | |
| total d (in.) | .056 | .045 | .035 | .026 | .017 | .013 | |
| tension (lbs.) | 27.2 | 31.0 | 32.5 | 30.2 | 28 | 28.5 | 177 |

EXAMPLE 17

The following example illustrates the use of a mixed set of low tension Ti alloy core strings together with steel core strings. The strings in this example were simultaneously strung and tuned to conventional pitch values on a Taylor acoustic guitar. The overall diameters are comparable to those of conventional acoustic strings. However, the cumulative tension is considerably less than that for conventional sets, and the Ti alloy core strings are characterized as being qualitatively easier to fret in part due to their lower stiffness when compared to conventional strings. Calculations are based on a 25.5" speaking length, and material densities as given in example 15.

| string | core type & d (in.) | winding type & d (in.) | overall d (in.) | tension (lbs.) |
|---|---|---|---|---|
| E (example 9) | Ti/0.018 | phosphor bronze/ 0.0175 | 0.053 | 23.2 |
| A (example 13) | Ti/0.018 | Ni 200 0.0126 | 0.043 | 28.6 |
| D (example 11) | Ti/0.018 | phosphor bronze 0.008 | 0.034 | 30.5 |
| G (D'Addario EJ16) | steel/0.014 | phosphor bronze/ 0.005 | 0.024 | 31.4 |
| B (example 1) | Ti/0.018 | | 0.018 | 18.5 |
| high E (example 1) | Ti/0.013 | | 0.013 | 17.2 |
| cumulative tension (lbs.) | | | | 149.5 |

EXAMPLE 18

The following example illustrates yet another facet of this invention which makes it possible to produce wound and non-wound metallic strings for use on classical guitars. The overall string diameters in this example are equal to D'Addario EJ16 phosphor bronze light acoustic steel core strings, but the use of a titanium alloy core with commercially pure titanium windings enables the achievement of much lower cumulative tension; similar to that of conventional nylon strings for classical guitars. Thus, unlike, the D'Addario steel core strings, the Ti strings in this example could be used on either a conventional steel string body guitar, or on a classical body guitar. Calculations are based on a 25.5" speaking length, and material densities as given in example 15.

Tension calculations for conventional nylon and phosphor bronze wound nylon strings for classical guitar.

| | E | A | D | G | B | high E | total T (lbs.) |
|---|---|---|---|---|---|---|---|
| core d (in.) | .019 | .017 | .017 | .039 | .031 | .027 | |
| winding d (in.) | .013 | .0105 | .007 | | | | |
| total d (in.) | .045 | .038 | .031 | .039 | .031 | .027 | |
| tension (lbs.) | 15.1 | 19.0 | 20.3 | 12.6 | 12.7 | 17.1 | 96.8 |

Tension calculations for commercially pure Ti wound on Ti alloy core strings of example 1 with equivalent diameter to D'Addario EJ16 light acoustic strings, but with cumulative tension adequate for use on classical body guitars.

| | E | A | D | G | B | high E | total T (lbs.) |
|---|---|---|---|---|---|---|---|
| core d (in.) | .018 | .017 | .016 | .014 | .016 | .012 | |
| winding d (in.) | .0175 | .0125 | .008 | .005 | | | |
| total d (in.) | .053 | .042 | .032 | .024 | .016 | .012 | |
| tension (lbs.) | 13.4 | 15.4 | 16.4 | 16.9 | 14.6 | 14.7 | 91.4 |

EXAMPLE 19

This example illustrates the difference in corrosion resistance between metallic strings constructed with Ti alloy and steel cores, and also serves to illustrate the superior corrosion resistance which is afforded by the present invention. 30 ml glass vials with lids were half filled with a saturated aqueous NaCl stock solution. Various wound and non-wound materials were cut into 2" strips, and were placed into the vials with a portion of each sample submerged below the water line, and with a portion above the air/water interface. Each string sample was prepared with approximately 0.25" of the core exposed on both ends so What core corrosion vs. winding corrosion could be visually monitored over time. Samples were all sealed with lids, and were left undisturbed in storage at 23° C.

Table 1 summarizes the constructions of all materials tested in this example. The constructions include sections cut from strings described in prior examples, as well as strings which were dissected or constructed specifically for this example.

Table 2 summarizes the performance of the various samples after 3.5 days of exposure. The samples in this table are divided into four groups; A, B, C, and D in accordance with relative performance from best to worst. In general, the best samples exhibit no change, while the poor performing samples exhibit significant corrosion and formation of oxide precipitates.

Table 3 summarizes the corrosion results for all of the wound string samples after 30 days of exposure. The undisturbed samples were evaluated for core corrosion, and winding corrosion. A numerical ranking was then assigned based on the total amount of precipitate as judged by the opacity of the solution after vigorous shaking by hand.

TABLE 1

DESCRIPTION OF CONSTRUCTIONS FOR CORROSION TESTS

| SAMPLE | SOURCE/ DESCRIPTION OF MATERIAL | CORE | WINDING |
|---|---|---|---|
| 1 | example 1 | Ti alloy | none |
| 2 | example 2 | Ti alloy | Ti alloy |
| 3 | example 10 | none | Ni 200 |
| 4 | example 10 | Ti alloy | Ni 200 |
| 5 | example 12 | none | 52% Ni |
| 6 | example 12 | none | 430 stainless |
| 7 | D'Addario EJ16 "G" string core | tin coated steel | none |
| 8 | D'Addario medium "B" | silvered steel | none |
| 9 | D'Addario EJ16 "G" string core | tin coated steel | Ti alloy |
| 10 | D'Addario medium "B" | silvered steel | Ti alloy |
| 11 | John Pearse medium "A" winding | none | phosphor bronze |
| 12 | example 12 | Ti alloy | 52% Ni |
| 13 | example 12 | Ti alloy | 430 stainless |
| 14 | example 12 | none | Ni plated steel |
| 15 | D'Addario EJ16 "E" string core | tin coated steel | Ni plated steel |
| 16 | example 12 | Ti alloy | Ni plated steel |
| 17 | D'Addario EJ16 "E" string core | tin coated steel | 430 stainless |
| 18 | John Pearse medium "A" winding | Ti alloy | phosphor bronze |
| 19 | John Pearse medium "A" winding | tin coated steel | phosphor bronze |
| 20 | D'Addario EJ16 "E" string core | tin coated steel | Ni 200 |
| 21 | D'Addario EJ16 "E" string core | tin coated steel | 52% Ni |

TABLE 2

RELATIVE GROUPED PERFORMANCE AFTER 3.5 DAYS OF EXPOSURE

| SAMPLE/ GROUP/ CORE/WINDING | CORE CORROSION/ WINDING CORROSION (Yes or No) | OBSERVATIONS |
|---|---|---|
| 1/A/Ti alloy/none | N/— | no change |
| 2/A/Ti alloy/Ti aloy | N/N | no change |
| 3/A/none/Ni200 | —/N | no change |
| 4/A/Ti alloy/Ni200 | N/N | no change |
| 5/A/none/52% Ni | —/N | no change |
| 6/A/none/430 stainless | —/N | no change |
| 7/B/Sn steel/none | Y/— | slight orange precipitate |
| 8/B/Ag steel/none | Y/— | slight orange precipitate |
| 9/B/Sn steel/Ti alloy | Y/N | slight orange precipitate, and plating on windings |
| 10/B/Ag steel/Ti alloy | Y/N | slight orange precipitate, and plating on windings |
| 11/B/none/Phosphor Bronze | —/Y | slight pale blue precipitate |
| 12/B/Ti alloy/52% Ni | N/Y | no precipitate, but slight discoloration at air/water interface |
| 13/B/Ti alloy/430 stainless | N/Y | no precipitate, but slight discoloration at air/water interface |
| 14/C/none/Ni steel | —/Y | orange precipitate |

TABLE 2-continued

RELATIVE GROUPED PERFORMANCE AFTER 3.5 DAYS OF EXPOSURE

| SAMPLE/ GROUP/ CORE/WINDING | CORE CORROSION/ WINDING CORROSION (Yes or No) | OBSERVATIONS |
|---|---|---|
| 15/C/Sn steel/Ni steel | Y/Y | orange precipitate and plating on windings |
| 16/C/Ti alloy/Ni steel | N/Y | orange precipitate |
| 17/C/Sn steel/430 stainless | Y/N | " |
| 18/C/Ti alloy/ phosphor bronze | N/Y | blue precipitate |
| 19/D/Sn steel/phosphor bronze | Y/N | heavy orange precipitate |
| 20/D/Sn steel/Ni200 | Y/N | heavy orange precipitate |
| 21/D/Sn steel/52% Ni | Y/N | heavy orange precipitate |

TABLE 3

RELATIVE PERFORMANCE AFTER 30 DAYS OF EXPOSURE

| SAMPLE/ GROUP | RANK | CORE/ WINDING | CORE CORROSION/ WINDING CORROSION (Yes/No) |
|---|---|---|---|
| 2/A | 1 | Ti/Ti | N/N |
| 4/A | 1 | Ti/Ni200 | N/N |
| 9B | 3 | Sn steel/Ti | Y/N |
| 10/B | 5 | Ag steel/Ti | Y/N |
| 12/B | 2 | Ti/52% Ni | N/Y |
| 13/B | 4 | Ti/430 stainless | N/Y |
| 15/C | 9 | Sn steel/ Ni steel | Y/Y |
| 16/C | 7 | Ti/Ni steel | N/Y |
| 17/C | 10 | Sn steel/ 430 stainless | Y/Y |
| 18/C | 6 | Ti/phosphor bronze | N/Y |
| 19/D | 12 | Sn steel/phosphor bronze | Y/Y |
| 20/D | 11 | Sn steel/Ni 200 | Y/N |
| 21/D | 8 | Sn steel/52% Ni | Y/Y |

Collectively these data show that the most corrosion resistant strings are generally those with Ti alloy cores, especially Ni200 wound Ti alloy, and Ti alloy wound on a Ti alloy core. The string with the worst corrosion resistance is the phosphor bronze wound steel core, which is also one of the most commonly used constructions for commercial sale.

These data also show that the conventional steel cores as well as Ni plated steel and phosphor bronze windings can corrode by themselves, and that corrosion is often accelerated when two metals are coupled. Surprisingly, a Ti alloy core by itself is not sufficient to insure corrosion resistance as can be seen from the fact that the corrosion of the phosphor bronze winding is accelerated in the presence of the Ti alloy.

A comparison of these trends to the relative electrochemical potentials for several of these metals based on the galvanic series in sea water (*Metals Handbook Desk Edition*, second edition, J. R. Davis-Editor, ASM International, Materials Park, Ohio, 1998, p.1228) generally reveals that the greater the difference in electrochemical potential between the winding and core, the greater the degree of corrosion. For example, the Ti/Ti couple is zero and the Ni200/Ti couple is nearly zero, and these samples exhibit no corrosion, while the phosphor bronze/steel and Ni200/steel couples lead to extreme corrosion. Also, the more cathodic member of the couple seems to generally corrode by the least amount. For example, the more cathodic Ti does not corrode in the Ti/phosphor bronze couple, and similarly, the Ni200 does not corrode in the steel/Ni200 couple. Thus, the best corrosion resistance for a musical instrument string should generally occur when the difference in galvanic potential between the winding and core is minimized.

Surprisingly however, this is not enough to insure the best performance. For example, a nickel plated steel winding and a steel core should be nearly equivalent in galvanic potential (approximately −0.59 Volts), yet this wound string exhibits extreme levels of corrosion. Ni 200 and Ti are nearly equivalent in potential (approximately −0.1 Volts), yet Ni 200 accelerates the corrosion of a steel core much more than does Ti. The absolute value of the difference in electrochemical potential between phosphor bronze and Ti should be similar to the absolute value of the difference between phosphor bronze and steel (approximately 0.3 Volts), yet the phosphor bronze/steel couple leads to a much greater degree of corrosion than the phosphor bronze/Ti couple. These findings collectively reveal that the most corrosion resistant wound string will be one where the core wire is not only the more cathodic of the couple, but is also the more cathodic with respect to a saturated calomel reference electrode.

EXAMPLE 20

This example illustrates the effect that a surface treatment has on the corrosion resistance of both steel core and Ti alloy core strings. The phosphor bronze winding for this example was removed from a John Pearse medium "A" string, and the tin coated steel core was taken from the same string. The phosphor bronze winding was washed with ethanol, and then a portion was surface treated by dipping into a solution of 1% by weight benzotriazole dissolved in a 95/5 (weight percent) mixture of ethanol and water. The phosphor bronze was submerged for 1 hour in this solution, and was then removed and allowed to air dry. Portions of the treated and untreated phosphor bronze wires were then re-wound around the tin coated steel core, and also around the 0.018" Ti alloy core from example 1. Using the procedures of example 19, the samples were tested for relative corrosion behavior in saturated aqueous NaCl solutions. Results are tabulated below.

| CORE | WINDING | BTA TREATMENT (Y/N) | RESULT AFTER 3 DAYS | RESULT AFTER 30 DAYS |
|---|---|---|---|---|
| Sn steel | phosphor bronze | N | orange precipitate | heavy orange and black precipitates |
| Sn steel | phosphor bronze | Y | orange precipitate | heavy orange and black precipitates |
| none | phosphor bronze | N | slight blue precipitate | slight blue precipitate |
| none | phosphor bronze | Y | no change | no change |
| Ti alloy | phosphor bronze | N | blue precipitate | blue precipitate |
| Ti alloy | phosphor bronze | Y | no change | no change |

These results demonstrate that the corrosion of the more anodic steel core is surprisingly accelerated by the phosphor bronze copper alloy independent of the alloy's surface treatment. On the other hand, surface treatment of the winding leads to effective inhibition of corrosion in the presence of the more cathodic core. Collectively, these results demonstrate that corrosion surface treatments alone are not enough to improve the corrosion resistance of a musical instrument string. Instead, the most corrosion resistant musical instrument string is the one with the more cathodic titanium alloy core; and only with this core does a surface treatment seem to have an effect.

It is to be appreciated that certain features of the present invention may be changed without departing from the overall scope of present invention. Thus, for example, it is to be appreciated that although the invention has been described in terms of a preferred embodiment in which low tension, corrosion resistant musical instrument strings are constructed with titanium alloy cores, and in which methods for maintaining winding tightness and tonal qualities are disclosed; the musical instrument strings comprehended by the present invention can include any metal core that is more cathodic than steel, and is capable of delivering the desired combination of physical properties including low elongation under stress, low stress relaxation, high yield stress, and high tensile stress. Windings may include any from a variety of commercially available materials, but preferably those which are electrochemically equivalent or close in equivalence to the more cathodic core. Alternative windings of lower mass could also be employed for the purpose of further reducing the cumulative tension so that other varieties of metallic strings could be used on low tension instruments such as classical guitars. Also, windings for use with a Ti alloy core should not be excluded simply because they are worse in terms of corrosion, since some combinations may be desirable for their tonal characteristics or manufacturability. In such cases it is possible to improve the corrosion resistance by surface treating the winding or the entire construction. In the case of copper alloy windings, this surface treatment could be of any variety, including any compound from the broad family of azole compounds, such as benzotriazole. Although the preferred method for maintaining winding tightness is one where the use of polymers and ductile materials within the speaking length of the string is minimized, it can be appreciated that the low tension, corrosion resistant constructions of this invention could be combined with other technologies if so desired, including ones where ductile metals coat the core over the length of the string, or where organic polymers or plasma coatings are used to coat either a portion of, or the entire wound structure. It can also be appreciated that with the appropriate titanium alloy diameter selection, the use of windings can be entirely eliminated as long as the resulting string stiffness is not objectionable.

Whereas the preferred embodiments of the present invention have been described above in terms of musical instrument strings for guitars, and other stringed instruments such as violins, cellos, dulcimers, banjos, mandolins, basses, pianos, etc., it will be apparent to those skilled in the art that the present invention will also be valuable with other devices which employ wound structures such as resistors, springs, tennis rackets, fishing equipment, marine equipment, etc.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A musical instrument string comprising a metallic core member and a metallic wrap wire helically wound about said core wire, wherein the core member is formed of a cathodic metal of electrochemical potential greater than −0.5 volts with respect to a saturated calomel reference electrode, the core member is either electrochemically equivalent to the wrap wire or is more cathodic than the wrap wire, and any difference in galvanic potential between the core member and wrap wire is of absolute value less than 0.5 volts.

2. A musical instrument string as recited in claim 1, wherein the core member is a titanium or titanium alloy wire having a minimum ultimate tensile strength of greater than 140 ksi.

3. A musical instrument string as recited in claim 1, wherein the core member is a titanium alloy core wire which is cold drawn and heat aged to produce a minimum ultimate tensile strength of greater than 170 ksi.

4. A musical instrument string as recited in claim 1, wherein the core member is a titanium alloy wire which is cold drawn, and subsequently heat aged under an inert atmosphere or vacuum to produce a minimum ultimate tensile strength of greater than 180 ksi.

5. A musical instrument string as recited in claim 1, wherein either one or both the core member and wrap wire is ferromagnetic.

6. A musical instrument string as recited in claim 1, wherein the wrap wire is a stainless steel, nickel, nickel alloy, titanium, titanium alloy, copper alloy wire, or a copper alloy wire surface treated with an azole compound.

7. A musical instrument string as recited in claim 1, wherein the core member is a titanium alloy wire having a minimum ultimate tensile strength of greater than 170 ksi, and the encircling wrap wire is a ferromagnetic nickel wire, a stainless steel wire, a nickel alloy wire, a titanium wire, a titanium alloy wire, a copper alloy wire, a surface treated copper alloy wire, or a monofilament nylon polymer.

8. A musical instrument string as recited in claim 1, wherein the galvanic potential of the core member substantially matches the galvanic potential of the wrap wire.

9. A musical instrument string as recited in claim 1, wherein the wrap wire is comprised of nickel, titanium, titanium alloy wire, or a copper alloy wire surface treated with an azole compound.

10. A musical instrument string as recited in claim 1, wherein the core member is comprised of a titanium beta-C alloy.

11. A musical instrument string comprised of a core wire, an inner sheathing material encapsulating at least a portion of the core wire, and a wrap wire concentrically wound over the inner sheathing, wherein the inner sheathing is comprised of either a heat shrinkable monofilament nylon fiber; a low modulus, low-creep, and non-damping elastomeric polymer; a heat shrinkable polymeric tube; a thermally, or photochemically cured polymer from liquid precursors of solvent borne, water borne, monomeric, or oligomeric prepolymers; a coating of a water based latex polymer, a lacquer based polymer, or a fusible plastisol polymer; and where said wrap wire is under a state of sufficient tension so as to place the inner-sheathing in a state of compression, wherein the interstitial spaces between the outer wrap wire and the core wire are thereby filled by said inner sheathing material, so as to maintain the tightness of the outer wrap winding over time.

12. A musical instrument string comprised of a core wire, an inner sheathing material encapsulating a portion of the core wire, and a wrap wire concentrically wound over the inner sheathing, where the inner sheathing is completely outside of the speaking length of the string on one or both ends and acts to maintain the tightness of the wrap wire over time.

13. A musical instrument string as recited in claim 12, wherein the inner sheathing material encapsulates the core over a section outside of the speaking length of the string, so as to minimize dampening of string vibration over its speaking length, while still maintaining tightness of the outer wrap wire over time.

14. A musical instrument string as recited in claim 12, wherein the inner sheathing material is comprised of a polymeric material.

15. A musical instrument string as recited in claim 12, wherein the inner sheathing material is comprised of a metallic sleeve, a crimpable swage, a metallic brazing or a metallic coating.

16. A musical instrument string comprised of a core wire, a wrap wire wound about the entire length of the string, and an outer sheathing material encapsulating the wrap wire over a section which is completely outside of the speaking length of the string on one, or on both ends, so as to minimize dampening of string vibration over its speaking length while still maintaining tightness of the wrap wire over time.

17. A musical instrument string as recited in claim 16, wherein the core wire is comprised of either a titanium alloy, or steel; and the wrap wire is comprised of nickel, a nickel alloy, a copper alloy, a copper alloy surface treated with an azole compound, stainless steel, or a titanium alloy.

18. A musical instrument string as recited in claim 16, wherein the outer sheathing material is comprised of a polymeric material.

19. A musical instrument string as recited in claim 16, wherein the outer sheathing material is comprised of a metallic sleeve, a crimpable swage, a metallic brazing or a metallic coating.

20. A musical instrument string comprised of a core wire, an inner-sheathing material encapsulating the core wire over its entire length or over a section of the string outside of its speaking length at one or at both ends, a metal wrap wire concentrically wound over the inner sheathing such that the metal wrap covers the entire length of the string, and an outer-sheathing material encapsulating the inner composite over a section of the string outside of its speaking length at one or both ends, so as to maintain tightness of the metal wrap wire over time.

21. A method for producing a wound musical instrument string formed of a core wire and a wrap wire helically wound about the core wire so as to maintain the tightness of the wrap wire without affecting the tonal and vibrational characteristics of the string, comprising providing a core wire having a metal wrap wire helically wound about the core wire, and forming an outer sheathing on a portion of the length of said wrap wire which lies completely outside a speaking length of said string.

22. A method for producing a wound musical instrument string formed of a core wire and a wrap wire helically wound about the core wire so as to maintain the tightness of the wrap wire without affecting the tonal and vibrational characteristics of the string, comprising providing a core wire, forming an inner sheathing on a portion of the length of said core wire which lies outside a speaking length of said string, and helically wrapping a metal wrap wire over said inner sheathing and said core wire about substantially the entire length of said core wire.

* * * * *